US007494209B2

(12) United States Patent
Bibl et al.

(10) Patent No.: US 7,494,209 B2
(45) Date of Patent: Feb. 24, 2009

(54) PRINTHEAD MODULE

(75) Inventors: Andreas Bibl, Los Altos, CA (US); Melvin L. Biggs, Norwich, VT (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 343 days.

(21) Appl. No.: 11/303,743

(22) Filed: Dec. 16, 2005

(65) Prior Publication Data

US 2006/0158486 A1 Jul. 20, 2006

Related U.S. Application Data

(60) Provisional application No. 60/699,134, filed on Jul. 13, 2005, provisional application No. 60/637,254, filed on Dec. 17, 2004.

(51) Int. Cl.
*B41J 2/045* (2006.01)

(52) U.S. Cl. ..... 347/68

(58) Field of Classification Search ..... 347/70, 347/71–72

See application file for complete search history.

(56) References Cited

U.S. PATENT DOCUMENTS

| | | | | |
|---|---|---|---|---|
| 5,606,352 | A | 2/1997 | Yamakawa et al. | |
| 5,721,576 | A | 2/1998 | Barinaga | |
| 5,732,751 | A | 3/1998 | Schmidt et al. | |
| 5,777,646 | A | 7/1998 | Barinaga et al. | |
| 5,781,213 | A | 7/1998 | Ujita et al. | |
| 5,880,764 | A | 3/1999 | Barinaga | |
| 6,183,077 | B1 | 2/2001 | Hmelar et al. | |
| 6,322,207 | B1 | 11/2001 | Hall et al. | |
| 6,341,842 | B1 * | 1/2002 | Beach et al. | 347/45 |
| 6,378,997 | B1 | 4/2002 | Nitta | |
| 6,428,142 | B1 | 8/2002 | Silverbrook | |
| 6,502,930 | B1 | 1/2003 | Shimada et al. | |

(Continued)

FOREIGN PATENT DOCUMENTS

| | | |
|---|---|---|
| EP | 1101615 | 5/2001 |

(Continued)

OTHER PUBLICATIONS

International Search Report and Written Opinion of the International Searching Authority, PCT Application Serial No. PCT/US2005/045672, May 8, 2006, 14 pp.

*Primary Examiner*—Luu Matthew
*Assistant Examiner*—Lisa M Solomon
(74) *Attorney, Agent, or Firm*—Fish & Richardson P.C.

(57) ABSTRACT

A printhead module includes a printhead body, a nozzle plate and one or more piezoelectric actuators. The printhead body includes one or more pumping chambers, where each pumping chamber includes a receiving end to receive a printing liquid from a printing liquid supply and an ejecting end for ejecting the printing liquid from the pumping chamber. The nozzle plate includes one or more nozzles formed through the nozzle plate. Each nozzle can be in fluid communication with a pumping chamber and receive printing liquid from the ejecting end for ejection from the nozzle. The one or more piezoelectric actuators are connected to the nozzle plate. A piezoelectric actuator is positioned over each pumping chamber and includes a piezoelectric material configured to deflect and pressurize the pumping chamber, so as to eject printing liquid from a corresponding nozzle in fluid communication with the ejecting end of the pumping chamber.

11 Claims, 21 Drawing Sheets

U.S. PATENT DOCUMENTS

| | | | |
|---|---|---|---|
| 6,848,773 | B1 | 2/2005 | Hoisington et al. |
| 7,114,801 | B2 | 10/2006 | Hall et al. |
| 7,147,310 | B2 | 12/2006 | Steinmetz et al. |
| 7,188,937 | B2 | 3/2007 | Wilson et al. |
| 7,284,843 | B2 | 10/2007 | Silverbrook |
| 7,328,985 | B2 | 2/2008 | Silverbrook |
| 2004/0183873 | A1 | 9/2004 | Steinmetz et al. |
| 2005/0093922 | A1 | 5/2005 | McGarry et al. |
| 2006/0158489 | A1 | 7/2006 | Bibl et al. |

FOREIGN PATENT DOCUMENTS

| | | |
|---|---|---|
| JP | 2000-158645 | 6/2000 |
| JP | 2001-301179 | 10/2001 |
| WO | 03/013863 | 2/2003 |

* cited by examiner

PRINTHEAD MODULE

CROSS REFERENCE TO RELATED APPLICATIONS

This application claims priority to pending U.S. Provisional Application Ser. No. 60/637,254, entitled "Single-Use Droplet Ejection Module", filed on Dec. 17, 2004, the entire contents of which are hereby incorporated by reference, and claims priority to pending U.S. Provisional Application Ser. No. 60/699,134, entitled "Single-Use Droplet Ejection Module", filed on Jul. 13, 2005, the entire contents of which are hereby incorporated by reference. This application is related to concurrently filed U.S. Application entitled "Single-Use Droplet Ejection Module", filed on Dec. 16, 2005, and assigned U.S. Ser. No. 11/305,824, by Andreas Bibl, John A. Higginson, Kevin Von Essen, and Antai Xu.

BACKGROUND

The following description relates to a printhead assembly including one or more nozzles.

An ink jet printer typically includes an ink path from an ink supply to an ink nozzle assembly that includes nozzles from which ink drops are ejected. Ink drop ejection can be controlled by pressurizing ink in the ink path with an actuator, which may be, for example, a piezoelectric deflector, a thermal bubble jet generator, or an electrostatically deflected element. A typical printhead has a line of nozzles with a corresponding array of ink paths and associated actuators, and drop ejection from each nozzle can be independently controlled. In a so-called "drop-on-demand" printhead, each actuator is fired to selectively eject a drop at a specific pixel location of an image, as the printhead and a printing media are moved relative to one another. In high performance printheads, the nozzles typically have a diameter of 50 microns or less (e.g., 25 microns), are separated at a pitch of 100-300 nozzles per inch and provide drop sizes of approximately 1 to 70 picoliters (pl) or less. Drop ejection frequency is typically 10 kHz or more.

A printhead can include a semiconductor printhead body and a piezoelectric actuator, for example, the printhead described in Hoisington et al., U.S. Pat. No. 5,265,315. The printhead body can be made of silicon, which is etched to define ink chambers. Nozzles can be defined by a separate nozzle plate that is attached to the silicon body. The piezoelectric actuator can have a layer of piezoelectric material that changes geometry, or bends, in response to an applied voltage. The bending of the piezoelectric layer pressurizes ink in a pumping chamber located along the ink path.

Printing accuracy can be influenced by a number of factors, including the uniformity in size and velocity of ink drops ejected by the nozzles in the printhead and among the multiple printheads in a printer. The drop size and drop velocity uniformity are in turn influenced by factors, such as the dimensional uniformity of the ink paths, acoustic interference effects, contamination in the ink flow paths, and the uniformity of the pressure pulse generated by the actuators. Contamination or debris in the ink flow can be reduced with the use of one or more filters in the ink flow path.

SUMMARY

A printhead assembly including one or more nozzles is described. In general, in one aspect, the invention features a printhead module including a printhead body, a nozzle plate and one or more piezoelectric actuators. The printhead body includes one or more pumping chambers, where each pumping chamber includes a receiving end configured to receive a printing liquid from a printing liquid supply and an ejecting end for ejecting the printing liquid from the pumping chamber. The nozzle plate includes one or more nozzles formed through the nozzle plate. Each nozzle is in fluid communication with a pumping chamber and receives printing liquid from the ejecting end of the pumping chamber for ejection from the nozzle. The one or more piezoelectric actuators are connected to the nozzle plate. A piezoelectric actuator is positioned over each pumping chamber and includes a piezoelectric material configured to deflect and pressurize the pumping chamber, so as to eject printing liquid from a corresponding nozzle that is in fluid communication with the ejecting end of the pumping chamber.

Implementations of the invention can include one or more of the following features. The printhead module can be included in a printhead system that includes a flexible circuit connected to a nozzle face of the printhead module. The flexible circuit is electrically coupled to the one or more piezoelectric actuators so as to provide signals to the one or more piezoelectric actuators to selectively pressurize the one or more pumping chambers to fire the one or more corresponding nozzles.

The printhead module can include a cap attached to the nozzle plate and including one or more apertures connecting to the one or more nozzles formed through the nozzle plate. The cap is configured to cover the one or more piezoelectric actuators while providing sufficient clearance for the piezoelectric material included in the one or more actuators to deflect when actuated.

The printhead module can include a printing liquid supply assembly, where the printing liquid supply assembly includes a reservoir in fluid communication with the receiving end of the pumping chamber. The printhead body can include a back face that is substantially parallel to a nozzle face which connects to the nozzle plate. The printing liquid supply assembly can be connected to the back face of the printhead body, and the receiving end of the pumping chamber can include an opening on the back face of the printhead body in fluid communication with the reservoir.

The printhead module can include a plurality of pumping chambers and further include at least one printing liquid channel formed in the back face of the printhead body. The printing liquid channel is in fluid communication with openings of the pumping chambers and with the reservoir. The printing liquid enters the printing liquid channel from the reservoir and is directed into the openings of the pumping chambers. In one implementation, the printing liquid channel includes at least two sides angled toward the openings of the pumping chambers.

The invention can be implemented to realize one or more of the following advantages. The printhead module can be fabricated using less silicon and with fewer fabrication steps then prior art printhead modules, for example, printhead modules incorporating a piezoelectric layer on the back face of the printhead body, as compared to the nozzle face of the printhead body. The required etch time can be reduced, thereby reducing the fabrication time. For example, ink channels included in the printhead module can be etched using a KOH etching process as compared to the more time-consuming Bosch process. Positioning the piezoelectric layer on the nozzle face of the printhead body can free up the back face of the printhead body for other features. For example, a heater can be integrated into the back face of the printhead body.

An ink supply can feed ink into the pumping chambers included in the printhead body from the back face, as compared to along a side of the printhead body. Feeding ink from the back face of the printhead body into the pumping chambers facilitates priming the pumping chambers, as the pumping chambers can fill by capillary action. Additionally, a length of a path from the ink supply into the pumping chamber can be shorter than if the ink enters through the side of the pumping chamber, thereby providing an improved frequency of response. Further, bonding the printhead module to a housing is facilitated by having the ink channels on the back face as compared to the sides, as an adhesive can be used along the sides without risk of the adhesive entering the ink channels. The printhead module can be fabricated from fewer layers, thereby reducing thickness variations across the module.

Details of one or more implementations are set forth in the accompanying drawings and the description below. Other features and advantages may be apparent from the description and drawings, and from the claims.

DRAWING DESCRIPTIONS

These and other aspects will now be described in detail with reference to the following drawings.

Like reference symbols in the various drawings indicate like elements.

DETAILED DESCRIPTION

A printhead module is described that includes pressurized pumping chambers to selectively eject a printing liquid from nozzles. A typical printing liquid is ink, and for illustrative purposes, the printhead module is described below in reference to ink as the printing liquid. However, it should be understood that the printing liquid can be other liquids, for example, electroluminescent material used in the manufacture of liquid crystal displays or liquid metals used in circuit board fabrication.

The printhead module includes actuators that can be selectively fired to pressurize pumping chambers and eject ink from corresponding nozzles. For example, in one embodiment an actuator is fired by applying a voltage to a piezoelectric material positioned over the pumping chamber. The applied voltage causes the piezoelectric material to deflect and pressurize the pumping chamber, thereby urging ink within the pumping chamber to eject from a corresponding nozzle. Circuitry provides drive signals to the actuator to control ejection from the nozzle. The piezoelectric material and at least some of the circuitry is provided on the same side of the printhead module as the nozzles. The printhead module can include a printhead body, a flexible circuit and an ink supply assembly.

Figure 1:
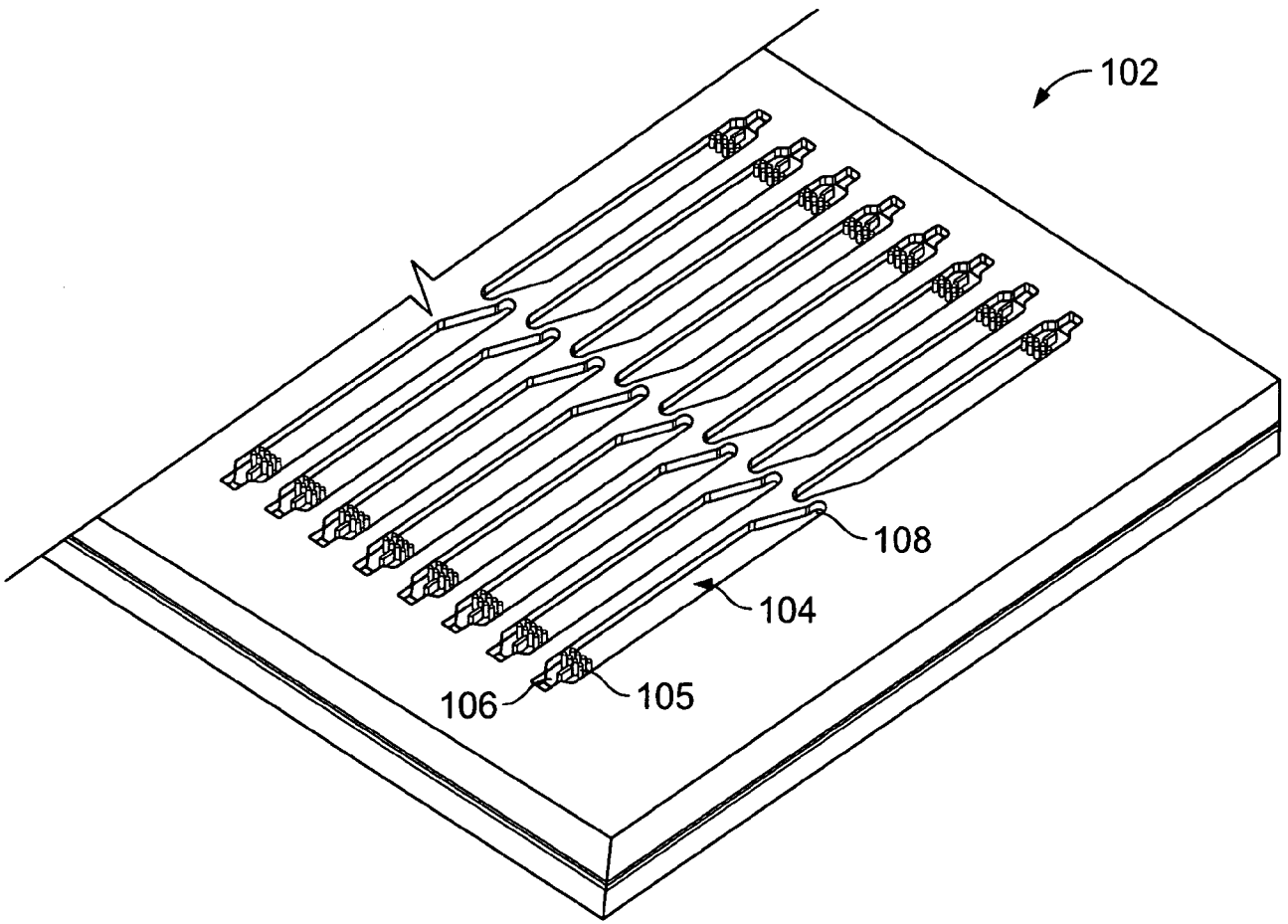
FIG. 1 shows a portion of a printhead body.

Referring to FIG. 1, a portion of an embodiment of a printhead body 102 is shown. The printhead body 102 is formed from a base substrate 101, a nozzle plate and a piezoelectric layer. The base substrate 101 can be a semiconductor, e.g., a MEMS silicon die. In the embodiment shown, the printhead body 102 includes multiple pumping chambers 104 for holding and pumping ink through multiple nozzles (only a few of the multiple pumping chambers are illustrated), e.g., 300 nozzles. It should be understood that more or fewer nozzle can be included.

The pumping chambers 104 can be etched into the printhead body 102 using etching techniques known in the art. Each pumping chamber 104 includes an ink receiving end 106 that is in fluid communication with an ink supply, and an ink ejecting end 108 that is in fluid communication with a nozzle. Ink enters the pumping chamber 104 through an opening (not shown) in the ink receiving end 106. Upon pressurization of the pumping chamber 104 the ink is forced out the ink ejecting end 108 and ejected from the corresponding nozzle. Exemplary means for pressurizing the pumping chamber 104 to "fire" the nozzle and an exemplary ink supply assembly shall be described further below.

Figure 2:
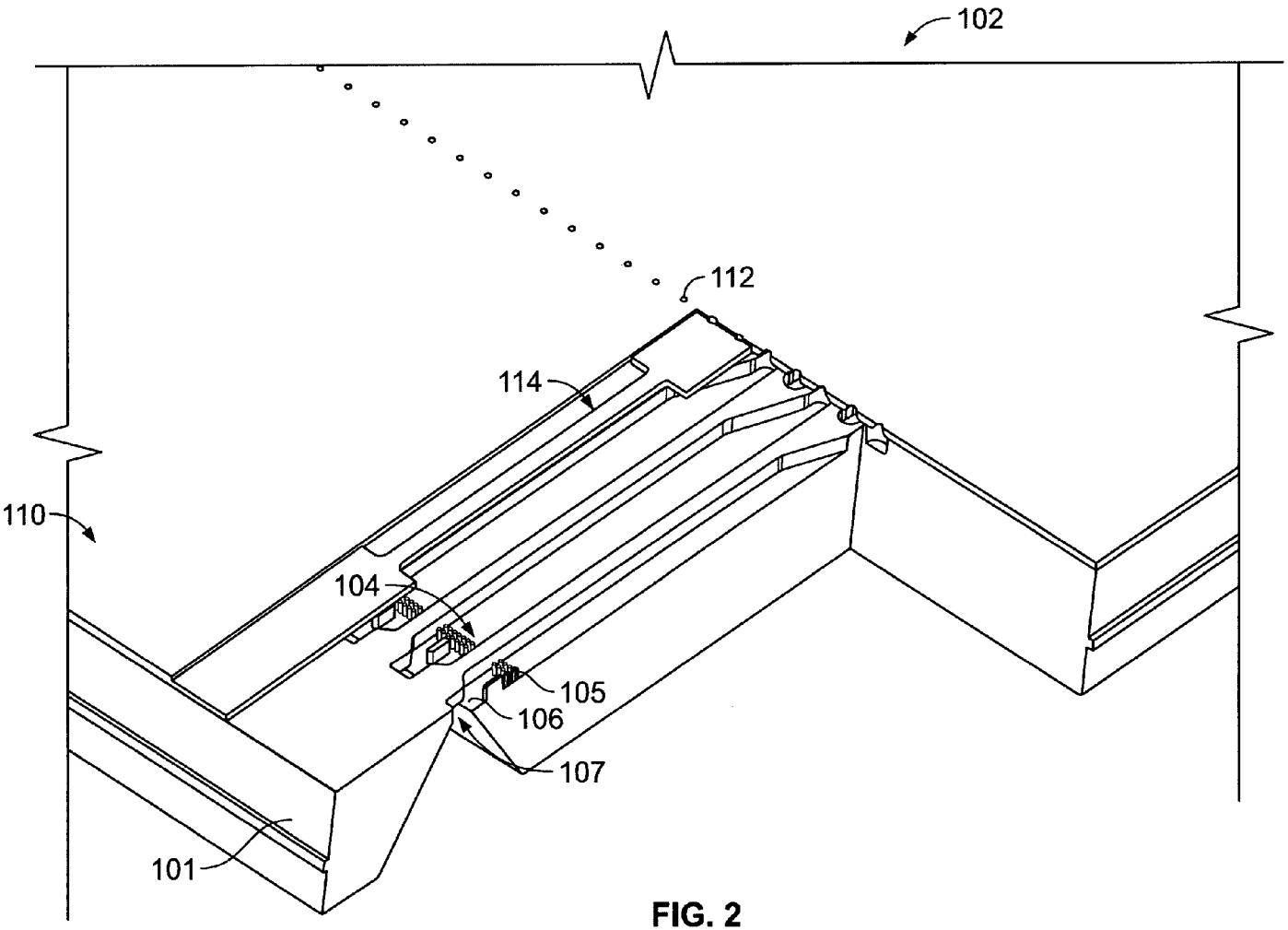
FIG. 2 shows a cutaway view of the portion of the printhead body of FIG. 1 with a cutaway view of a portion of a nozzle plate on top of the printhead body.

Referring to FIG. 2, a cut-away view of the printhead body 102 is shown. A nozzle plate 110 is shown on top of the base substrate 101, and is also shown as a cutaway view. The nozzle plate 110 defines multiple nozzles 112. Additionally, elongated regions of reduced thickness 114 are formed in the nozzle plate 110 positioned above the pumping chambers 104. For illustrative purposes, the regions of reduced thickness 114 are shown as openings in the nozzle plate 110, where the uppermost layer of the nozzle plate 110 has been cutaway. The nozzles 112 are positioned above, and are in fluid communication with, the ink ejecting ends 108 of the pumping chambers 104. An impedance feature 105, such as the exemplary posts depicted in FIG. 2, can create a resistance to reduce the amount of energy going into the ink outside the pumping chamber 104 to prevent a back flow of ink from the pumping chamber 104, and to direct the flow of ink toward and through the nozzle 112.

Figure 3A:
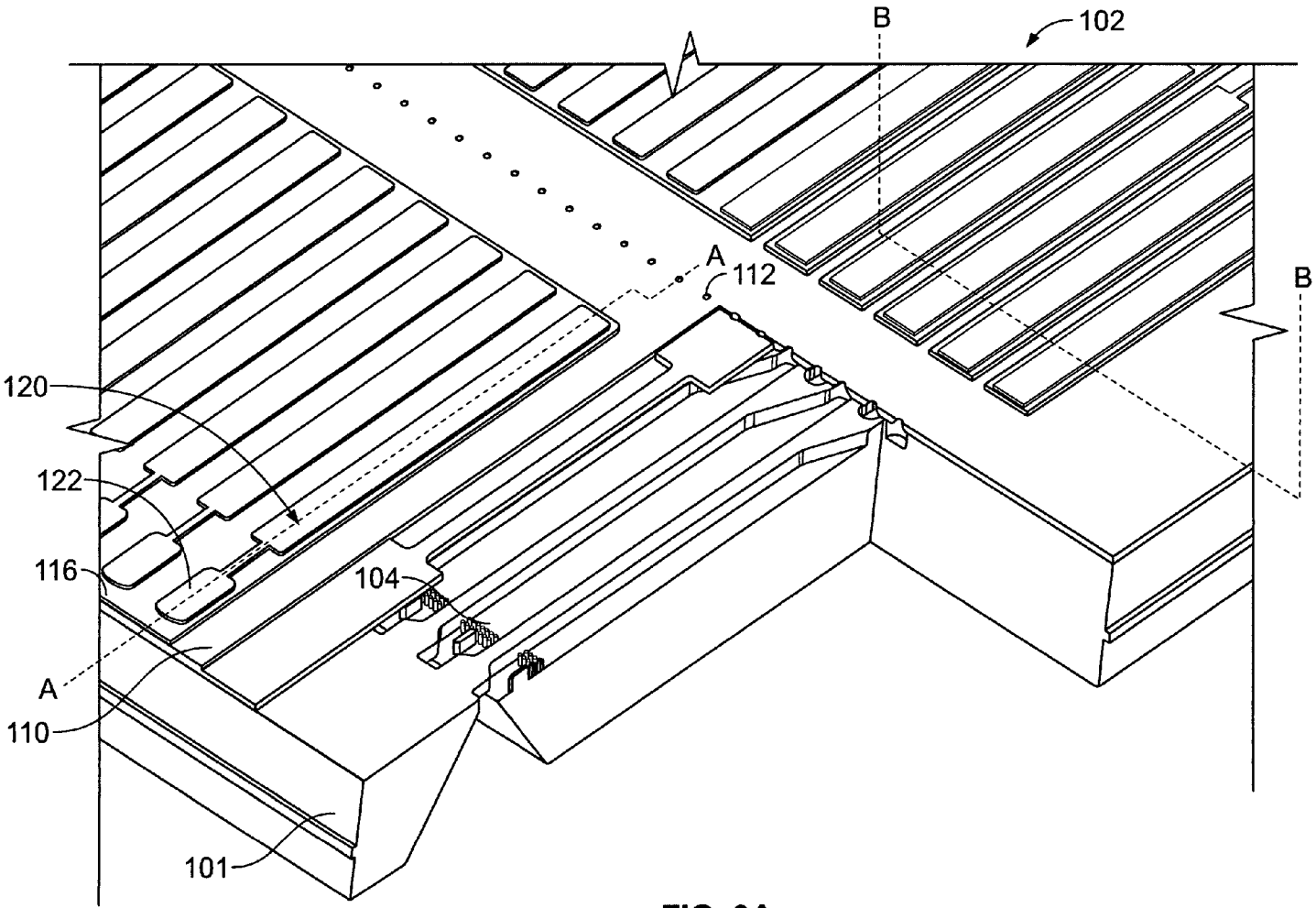
FIG. 3A shows a portion of a printhead assembly including a portion of a piezoelectric layer with electrical connectors thereon on top of the portion of the printhead body and nozzle plate shown in FIG. 2.

FIG. 3A shows a cut-away view of the printhead body 102, including a base substrate 101, a nozzle plate 110, and a piezoelectric layer 116 positioned on top of the nozzle plate 110. Drive contacts 122 and drive electrodes 120 are shown positioned on top of the piezoelectric layer 116. Each pair of drive contacts 122 and drive electrodes 120 corresponds to a pumping chamber 104 formed in the base substrate 101. In one embodiment, the drive contacts 122 and drive electrodes 120 are metallic traces, e.g., gold traces. The piezoelectric layer 116 is sectioned, as shown, to correspond with the positions of the pumping chambers 104. A ground electrode layer 117 is formed on the upper surface of the nozzle plate 110, with a cut-out region to expose the nozzles 112. The ground electrode layer 117 can be formed from metal, e.g., gold, and a voltage can be applied to the ground electrode layer 117 to create a voltage differential between the ground electrode layer 117 and the drive electrodes 120.

A drive contact 122 can receive a drive signal to apply a voltage across the piezoelectric layer 116 to fire the nozzle. The regions of reduced thickness 114 of the nozzle plate 110 provide a thin membrane over each of the pumping chambers 104. The drive signal received by the drive contact 122 causes a voltage to be applied to the drive electrode 120, thereby applying a voltage across the piezoelectric layer 116. A different voltage, e.g., a lower voltage, is applied to the ground electrode layer 117. The voltage differential between the drive electrode 120 and the underlying region of the ground electrode layer 117 causes the piezoelectric material above a region of reduced thickness 114 in the nozzle plate to deflect and pressurize the ink in the underlying pumping chamber 104.

Figure 3B:
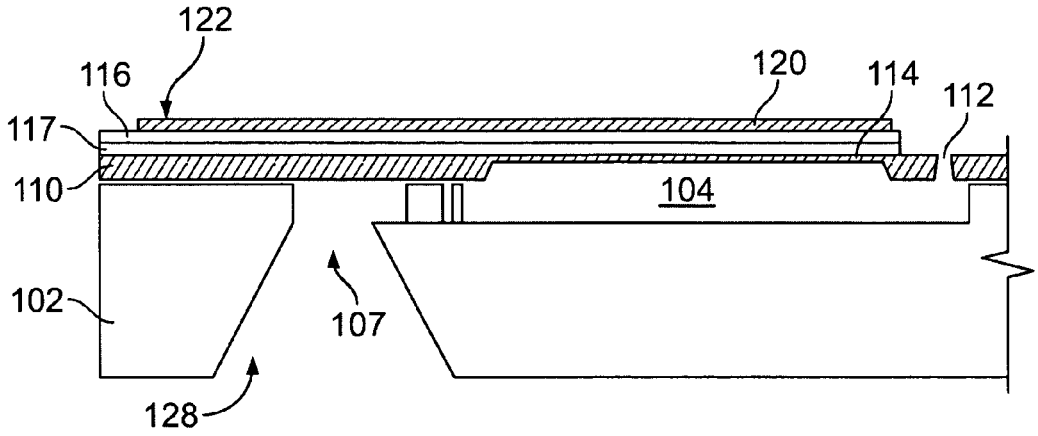
FIG. 3B is a cross-sectional view of the printhead assembly of FIG. 3A taken along line A-A.

FIG. 3B is a cross-sectional view of the printhead assembly of FIG. 3A taken along line A-A. A pumping chamber 104 is shown formed within the base substrate 101 and enclosed by the nozzle plate 110. The nozzle plate 110 is thinner over a substantial portion of the pumping chamber 104, in the region of reduced thickness 114. A nozzle 112 is formed through the nozzle plate 110 and is in fluid communication with the pumping chamber 104. The ground electrode layer 117 is between the nozzle plate 110 and the piezoelectric layer 116. As described above, a voltage can be applied to the drive electrode 120 to cause the piezoelectric layer 116 to deflect, thereby deflecting the nozzle plate 110 in the region of reduced thickness 114 and pressurizing the pumping chamber 104, forcing ink through the nozzle 112.

Figure 3C:
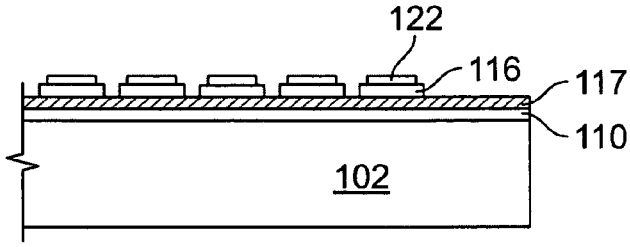
FIG. 3C is a cross-sectional view of the printhead assembly of FIG. 3A taken along line B-B.

An opening 107 in the ink receiving end 106 of the pumping chamber is shown. A trough-like ink channel 128 leads into the opening 107, to supply ink to the pumping chamber 104. The ink channel 128 receives ink from an ink supply, described further below. FIG. 3C is a cross-sectional view of the printhead assembly of FIG. 3A taken along line B-B. The ground electrode layer 117 is shown layered on top of the nozzle plate 110, which is on top of the base substrate 101. The sectioned piezoelectric layer 116 is shown with the drive electrodes 120 layered thereon.

Figure 4:
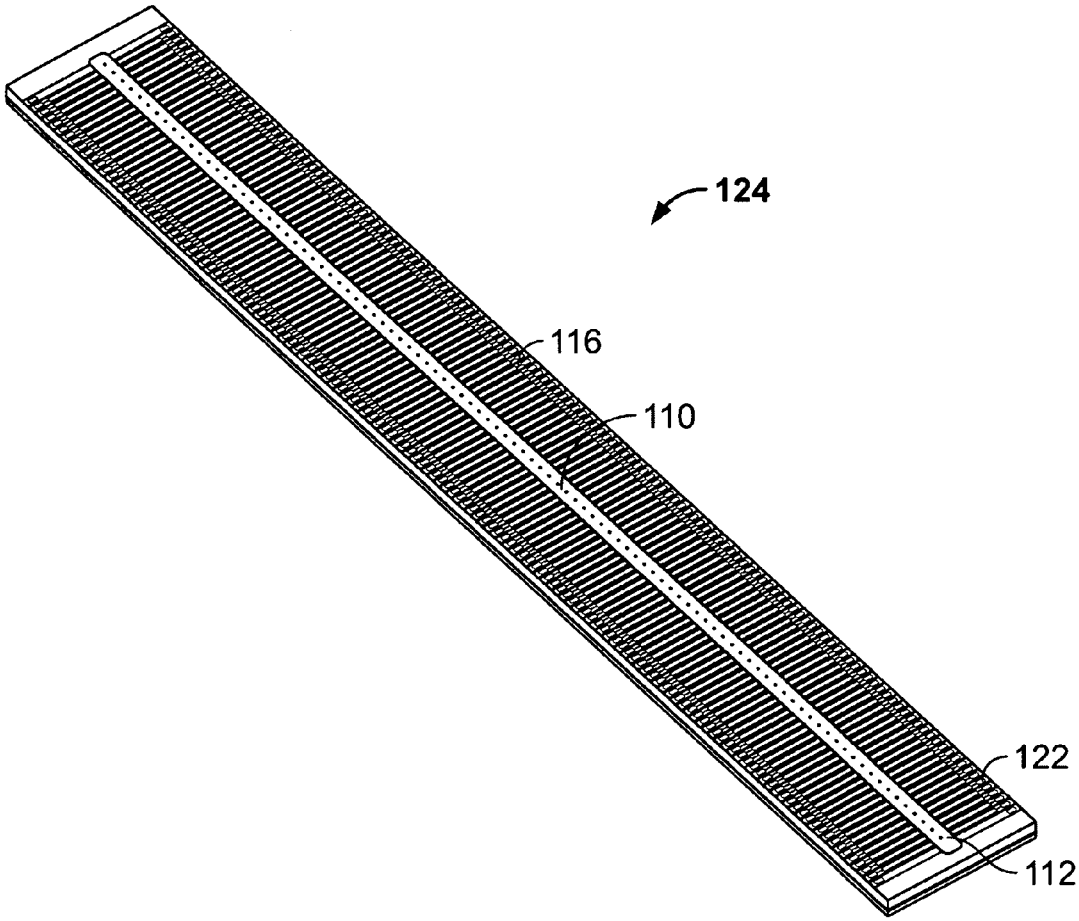
FIG. 4 shows a nozzle face of the printhead assembly of FIG. 3A.
Figure 5A:
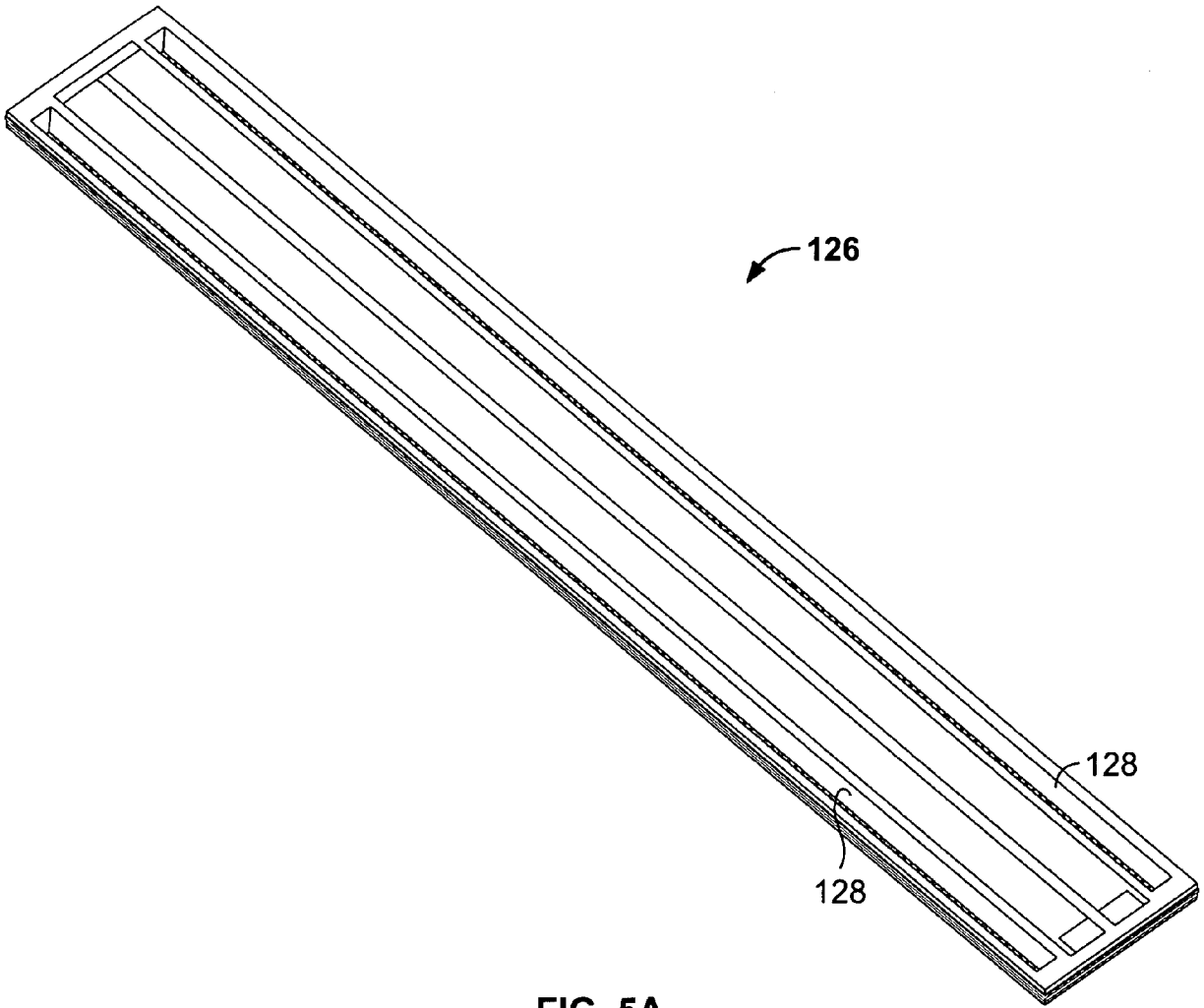
FIG. 5A shows a back face of the printhead assembly of FIG. 3A.
Figure 5B:
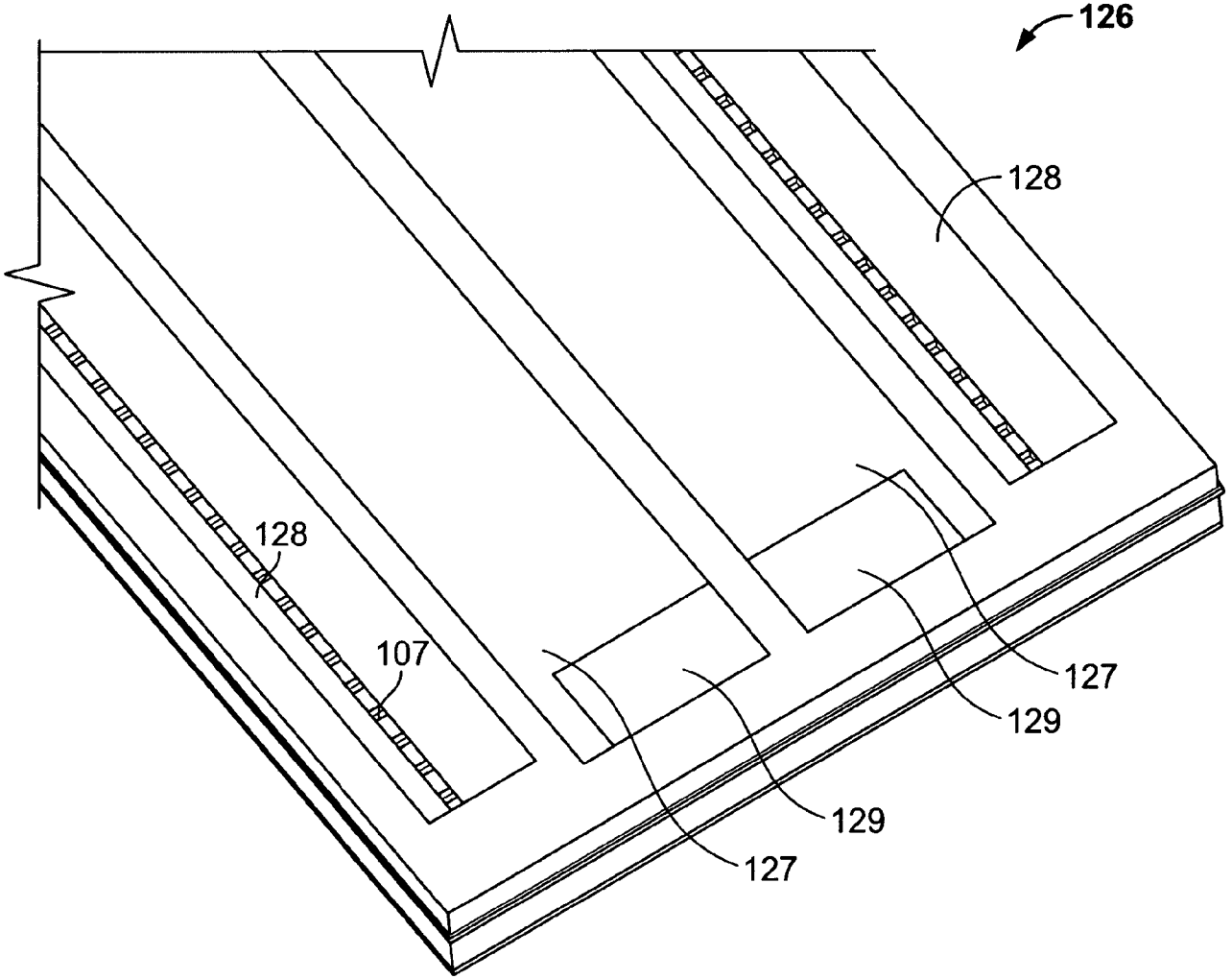
FIG. 5B shows an enlarged portion of the back face shown in FIG. 5A.

FIG. 4 shows the nozzle face 124 of the printhead body 102. FIGS. 5A and 5B show the back face 126 of the printhead body 102. FIG. 5A shows the entire back face 126, while FIG. 5B shows an enlarged, end portion of the back face of the printhead body 102. Along the length of both sides of the back face 126 of the printhead body 102 are two trough-like ink channels 128. Each ink channel 128 is in fluid communication with the pumping chambers 104 located along the corresponding side of the nozzle face 124 of the printhead body 102, by way of the openings 107 formed in the ink receiving ends 106 of the pumping chambers 104. Other configurations of the ink channels 128 can be used, for example, with curved surfaces. The trough-like configuration directs ink toward the openings in the ink receiving ends 106 of the pumping chambers 104. Alternatively, each opening 107 for a pumping chamber 104 can be connected to an ink supply by an individual ink channel, rather than a shared, continuous ink channel.

The ink channels 128 are in fluid communication with an ink supply. The ink supply can be positioned such that the ink path is directed from the ink supply into the openings in the ink receiving ends 106 of the pumping chambers from the back face 126 of the printhead body 102, as compared, for example, to the ink path being through the sides of the printhead body 102. This configuration facilitates priming of the pumping chambers 104 and nozzles 112. In one implementation, the ink travels into the pumping chambers 104 by capillary action, and the pumping chambers 104 do not have to be pressurized to move the ink from the opening in the ink receiving end 106 to fill the pumping chamber 104.

Optionally, heaters 127 can be positioned on or within the back face 126 of the printhead body 102. The heaters 127 can warm the printhead body 102, thereby warming the ink within the pumping chambers 104. In one embodiment, as shown in FIGS. 5A and 5B, a conductive material, e.g., Nichrome, can be sputtered onto the back face 126 of the printhead body 102 and photolithographically etched into a desired pattern, such as the elongated regions shown. A voltage can be applied to the conductive material by electrical contacts 129 to control the temperature of the conductive material and therefore the heat emitted from the heater 127. In another embodiment, the conductive material can be etched into a serpentine-like region and, optionally, the frequency of turns in the serpentine-like region can be increased toward the ends of the printhead body 102, to compensate for increased heat loss that typically occurs at the ends.

Figure 6:
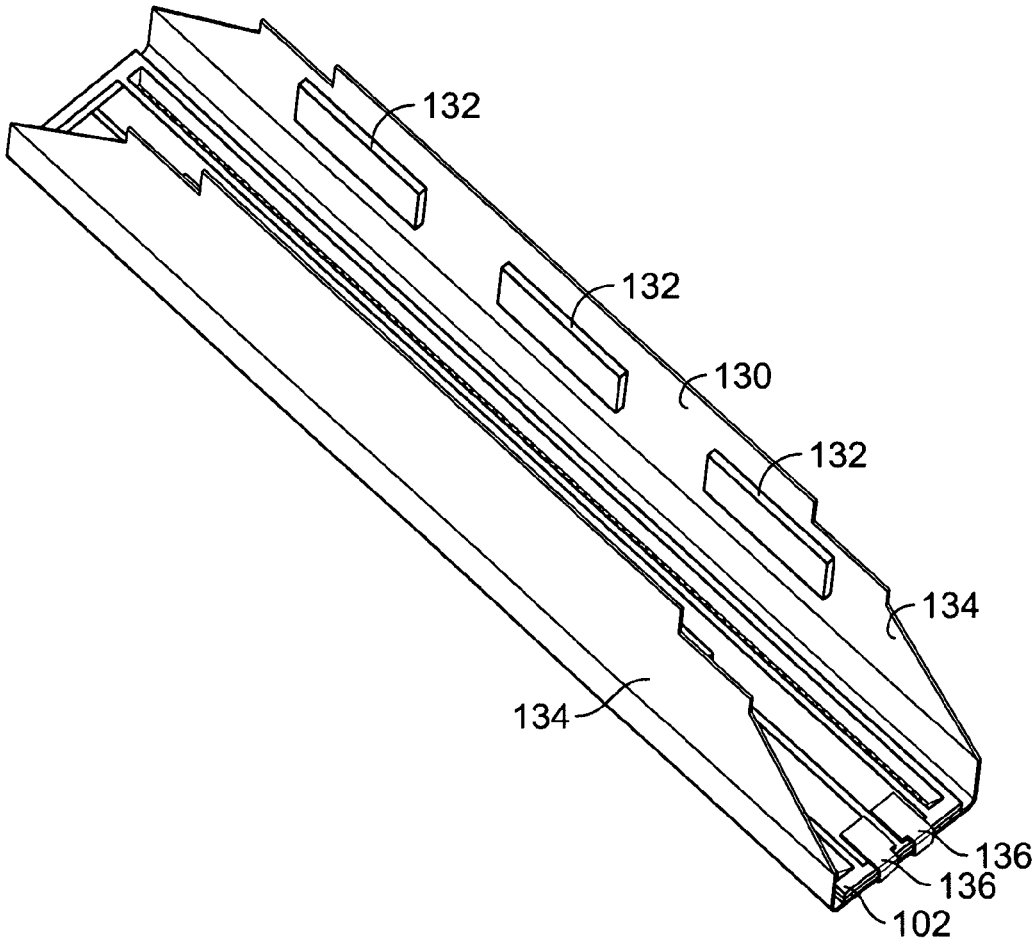
FIG. 6 shows a flexible circuit attached to the printhead assembly of FIG. 3A.

FIG. 6 shows a flexible circuit 130 assembled with the printhead body 102. The flexible circuit 130 wraps around the nozzle face 124 of the printhead body 102. Integrated circuits 132 included on one or both wings 134 of the flexible circuit 130 connect to output leads (not shown) that extend from the corresponding integrated circuit 132 to an inner face of the flexible circuit 130 that makes contact with the nozzle face 124 of the printhead body 102. The output leads electrically connect to the drive contacts 122 on the piezoelectric layer 116. Drive signals can thereby be passed from an integrated circuit 132 to the drive contacts 122 by the output leads to activate the piezoelectric material and selectively fire the nozzles 112.

The integrated circuits 132 are connected to an external source by the wings 134, which external source provides the drive signals by way of input leads (not shown) that electrically connect to the integrated circuits 132 through the flexible circuit 130. For example, the external source can be a processor included in a printing device integrating the printhead module. In one embodiment, there are five integrated circuits 132, each integrated circuit 132 sending signals to sixty (60) drive contacts 122 for a total of 300 drive contacts corresponding to 300 nozzles 112. More or fewer integrated circuits 132 can be used. Alternatively, for a printhead module including relatively few nozzles, circuitry can be provided directly through the flexible circuit 130 and all or some of the integrated circuits 132 can be eliminated.

In one implementation, the flexible circuit 130 additionally includes tabs 136 that fold over at least one end of the printhead body 102. The tabs 136 electrically connect to the electrical contacts 129 to control the temperature of the heaters 127.

Figure 7A:
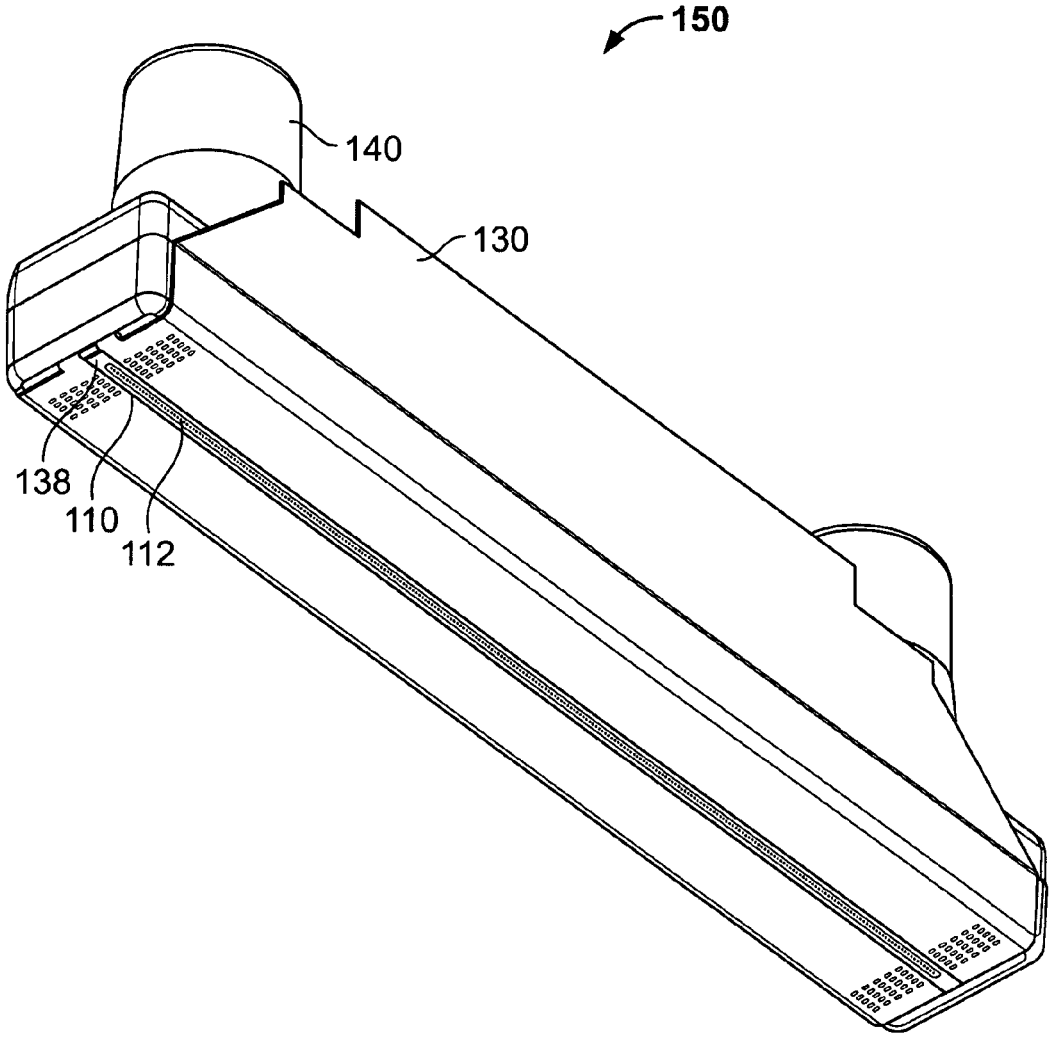
FIGS. 7A and 7B show perspective views of a printhead module including a printing liquid supply assembly, a flexible circuit and the printhead assembly of FIG. 3A.
Figure 7B:
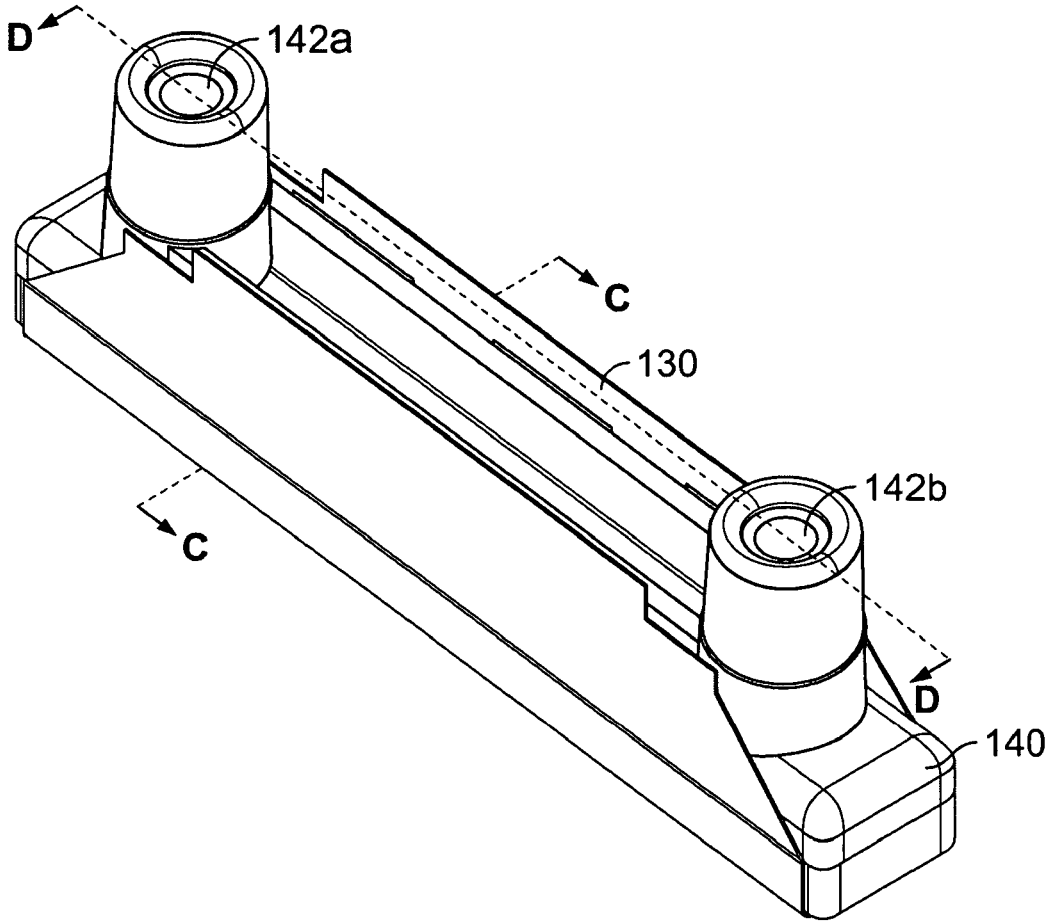

FIGS. 7A-D show a printhead module 150 including an ink supply assembly 140 positioned within the flexible circuit 130 attached to the printhead body 102. Referring to FIG. 7A, a view from the nozzle face 124 is shown. The flexible circuit 130 wraps around the nozzle face 124 of the printhead body 102, but includes an opening 138 to expose the nozzle plate 110 and the nozzles 112 formed therein. Alternatively, the flexible circuit 130 can be formed from a first portion that wraps around one side of the nozzle face 124 of the printhead body 102 and a second portion that wraps around the other side of the nozzle face 124 of the printhead body 102, the first and second portions not meeting on the nozzle face 124. The nozzles 112 formed on the nozzle plate 110 are therefore exposed between the first and second portions of the flexible circuit 130. FIG. 7B shows a view from the back face 126. In the embodiment of the ink supply assembly 140 shown, there are two ink inlets 142*a* and 142*b* that can receive ink from a remote ink source. Alternatively, one may be used as an ink inlet, e.g., 142*a*, while the other, 142*b*, may be used as an ink outlet, if ink is recirculating through the printhead module 150.

Figure 7C:
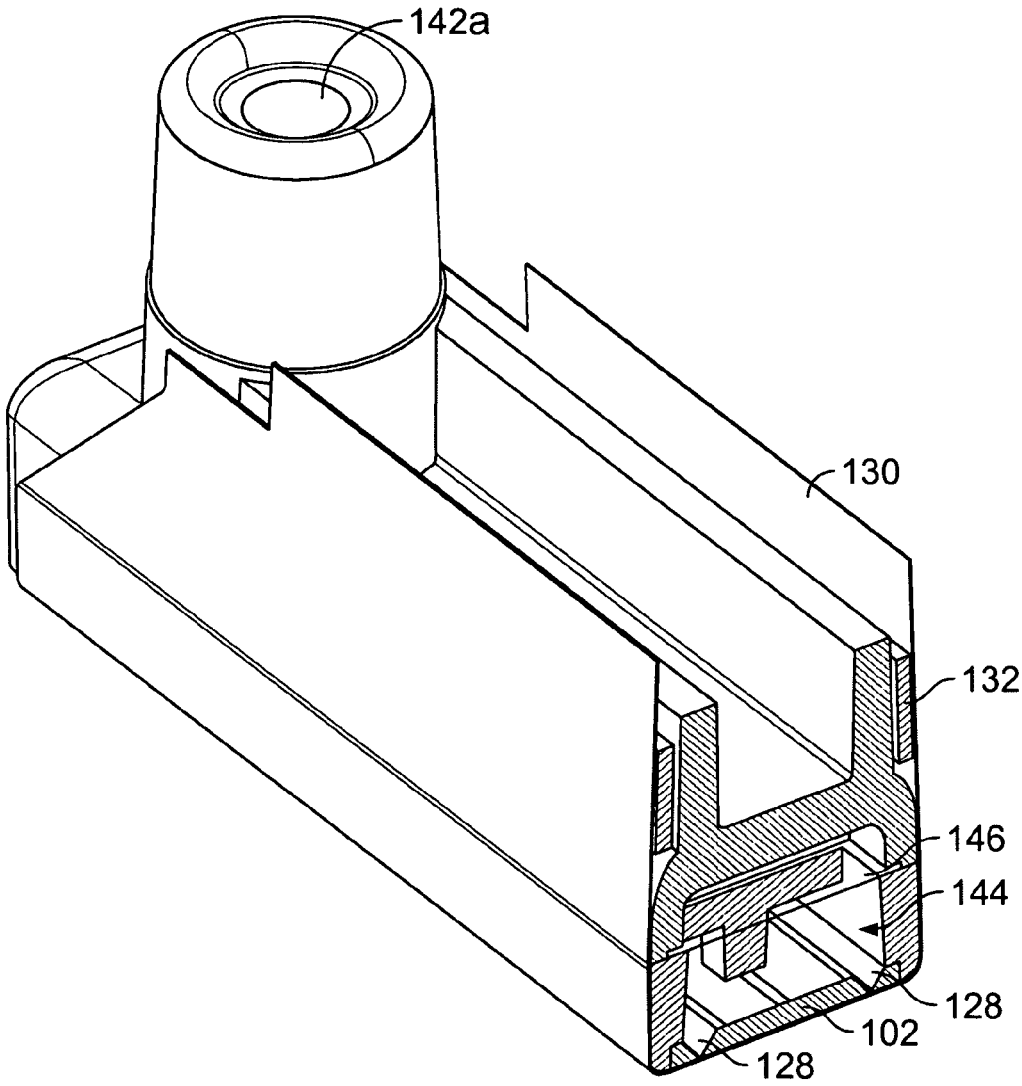
FIG. 7C shows a perspective, cross-sectional view of the printhead module of FIG. 7B taken along line C-C.

FIG. 7C shows a cross-sectional view of the printhead module 150 taken along line C-C shown in FIG. 7B. The embodiment of the ink supply assembly 140 shown includes a reservoir 144 for receiving ink. The reservoir 114 is formed by abutting the housing 143 of the ink supply assembly to the back face 126 of the printhead body 102. A filter 146 can be included in the reservoir 144 to filter contaminants from the ink before the ink is directed into the printhead body 102. The ink flows from the reservoir into the ink channels 128 formed in the back face 126 of the printhead body 102.

Figure 7D:
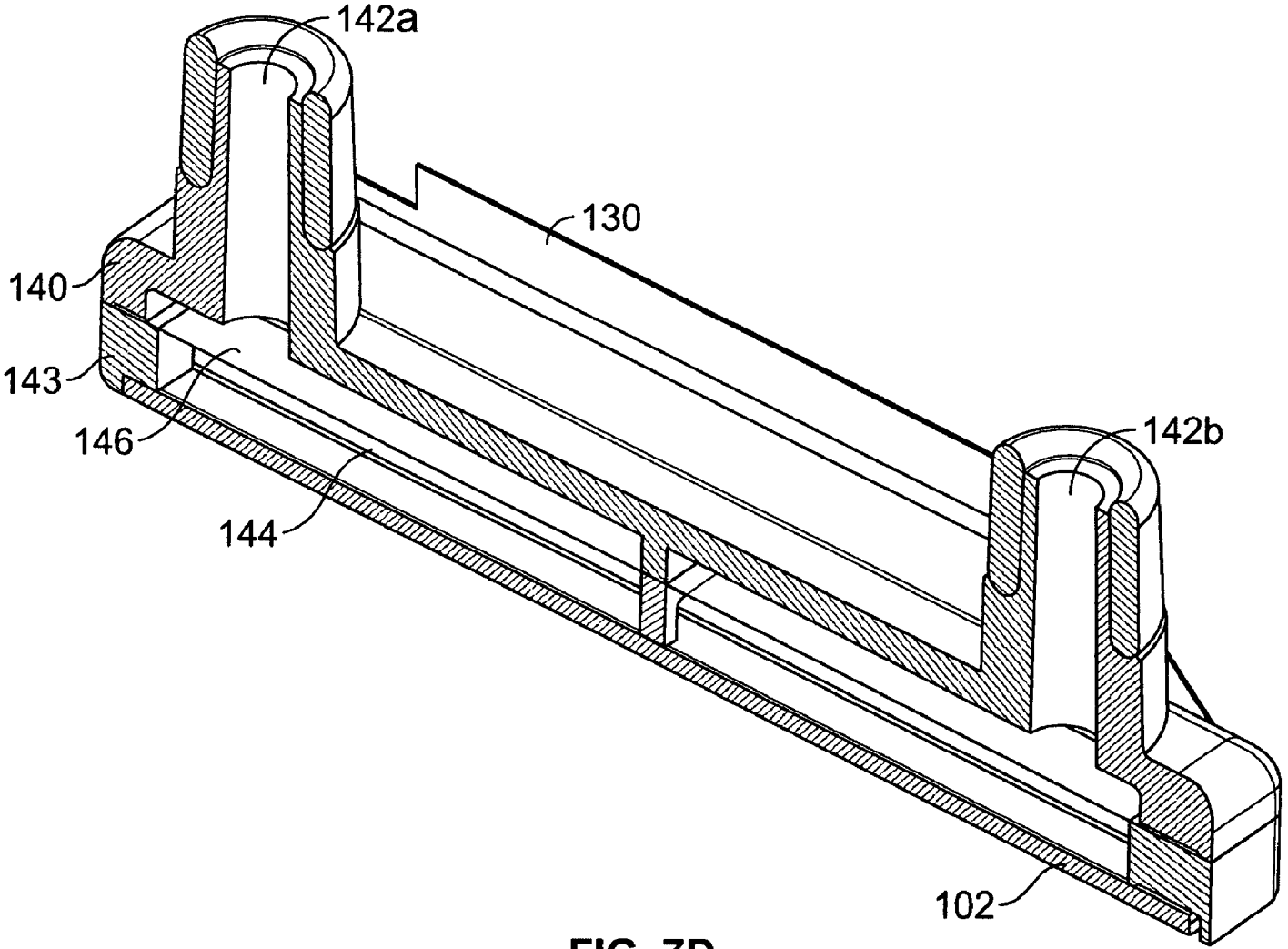
FIG. 7D shows a perspective, cross-sectional view of the printhead module of FIG. 7B taken along line D-D.

FIG. 7D shows a cross-sectional view of the printhead module 150 taken along line D-D shown in FIG. 7B. The embodiment of the ink supply assembly 140 shown includes a first ink inlet 142*a* and a second ink inlet 142*b* in fluid communication with a reservoir 144. The reservoir 144 includes upper and lower chambers which are separated by a filter 146. Ink can flow freely past a support post 147. If recirculating the ink through the printhead module 150, then one of the ink inlets 142*a*, 142*b* can operate as an ink inlet and the other can operate as an ink outlet, and the support post 147 can be configured to prevent flow between the two halves of the upper chamber.

Method of Manufacture

The printhead module 150 can be manufactured according to the process described below, which includes etching flow path features in the base substrate 101 and the nozzle plate 110. The piezoelectric layer 116, base substrate 101 and nozzle plate 110 are bonded together to form the printhead body 102. A flexible circuit 130 is then attached to the printhead body 102. FIG. 9 is a flowchart showing the process 400 for manufacturing the printhead module 150, which is described below in reference to FIGS. 3B, 3C and 8A-Q.

Figure 8A:
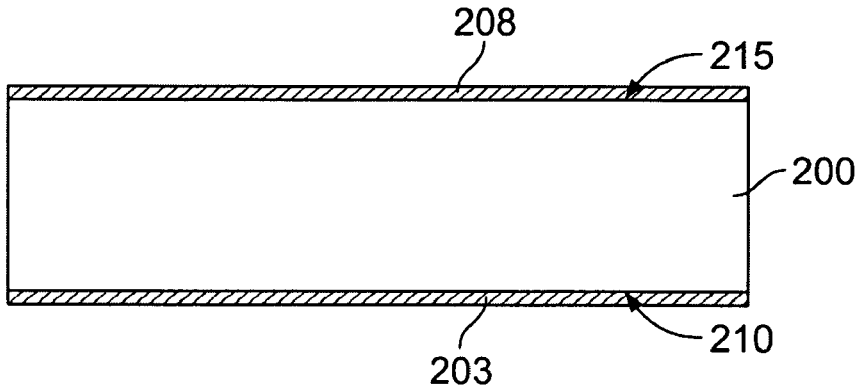
FIGS. 8A-8Q illustrate a process for manufacturing a printhead body.
Figure 9:
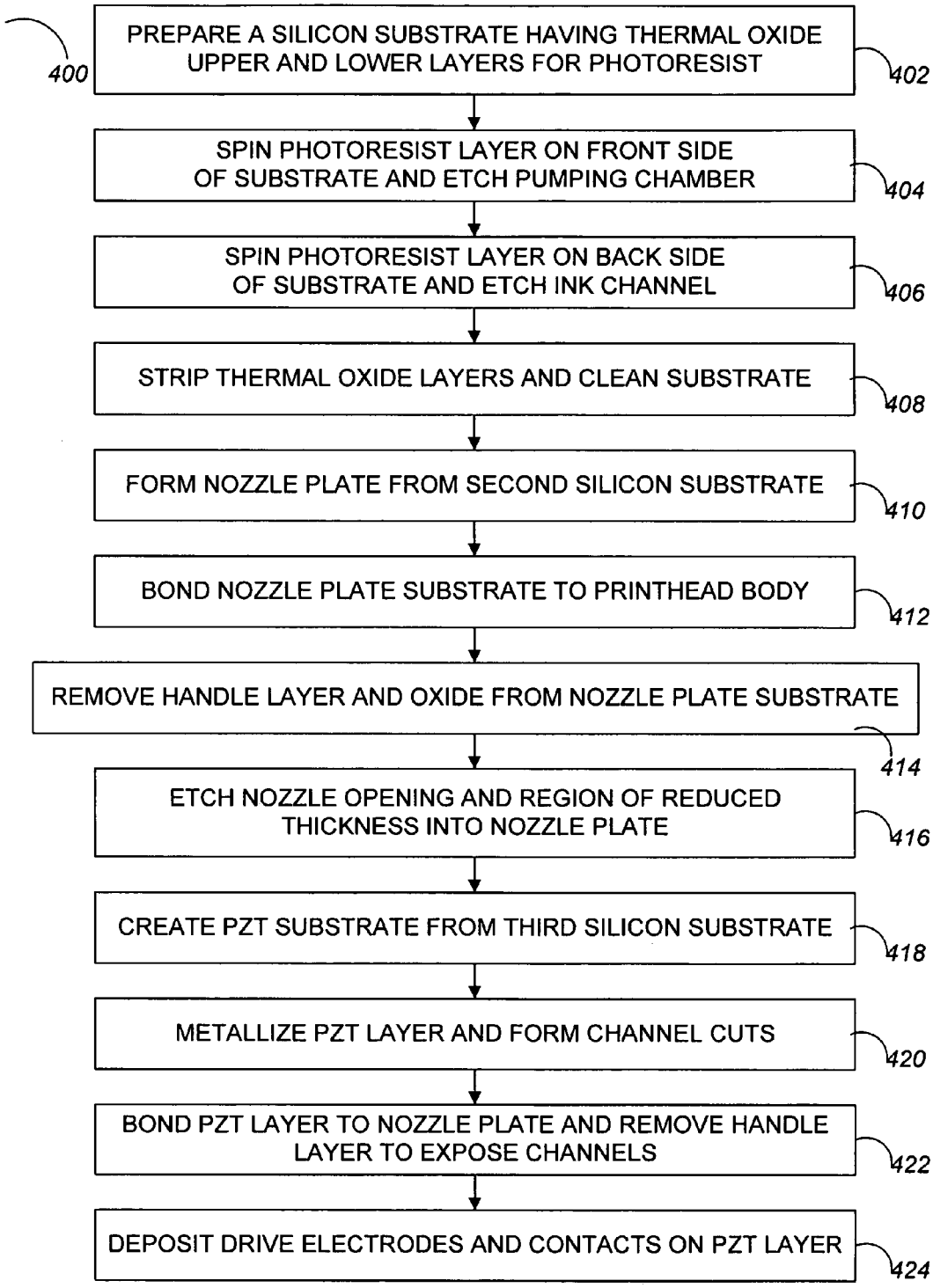
FIG. 9 is a flowchart showing steps of the process illustrated in FIGS. 8A-8Q.

Referring to FIG. 8A, the base substrate 101 is formed from a silicon substrate 200. The silicon substrate 200 has a front side 210 and a back side 215, and in one embodiment has an overall thickness of about 600 microns. There are thermal oxide layers 203, 208, each about 1 micron thick, on the front side 210 and back side 215 of the substrate 200. The silicon substrate 200 is piranha cleaned in a bath of sulfuric acid/hydrogen peroxide to remove organics. The substrate can be a silicon layer of single-crystal silicon with the plane parallel to the front and back sides 210, 215.

Figure 8B:
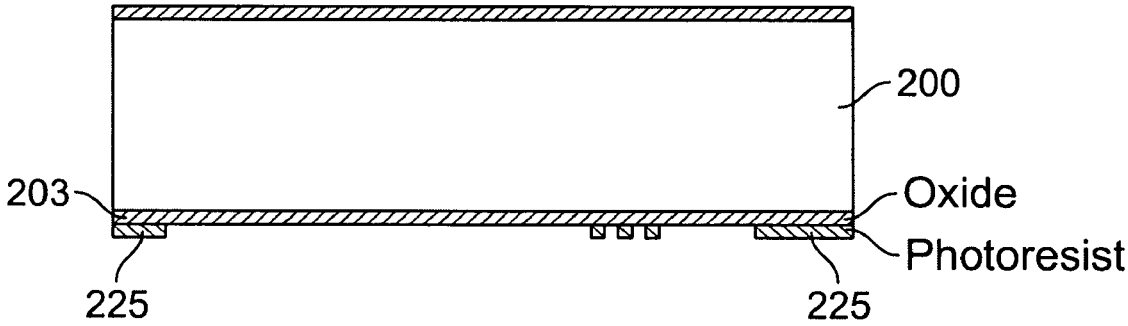

The silicon substrate 200 is processed to form the pumping chambers 104 and impedance features 105 by etching through a photoresist layer that is patterned to form a mask. To prepare the silicon substrate 200 for the photoresist layer, the substrate 200 is placed in hexamethyldisilazane (HMDS) fumes to prime the thermal oxide layer 203 for the photoresist layer (step 402). Referring to FIG. 8B, a positive photoresist layer 225 (Clariant AZ300T) is spun onto the front side 210 of the substrate 200. The photoresist layer 225 is soft baked, exposed with a Karl Suss through a chrome mask, and developed to form a mask defining the locations of the pumping chamber 104 and the impedance feature 105.

Figure 8C:
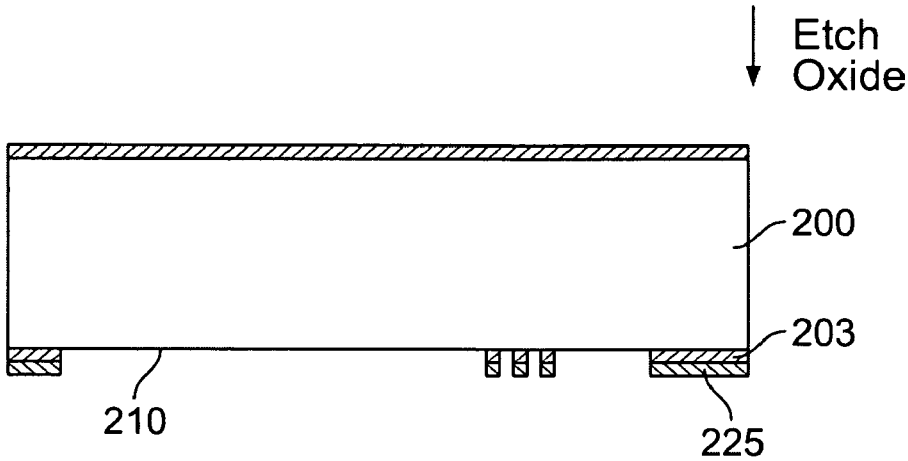
Figure 8D:
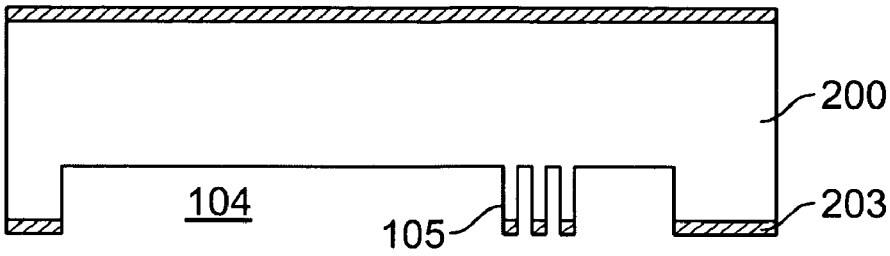

Referring to FIG. 8C, the front side of the silicon substrate 200 is plasma etched by inductively coupled plasma reactive ion etching (ICP RIE) to remove exposed portions of the thermal oxide layer 203; the silicon substrate 200 is not etched. The silicon substrate 200 is then etched using a Bosch process deep reactive ion etching (DRIE) technique to form the pumping chamber 104 and impedance feature 105, as depicted in FIG. 8D (step 404).

Figure 8E:
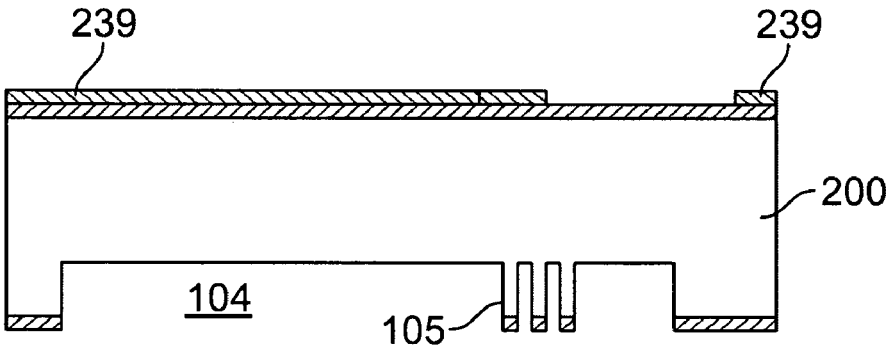
Figure 8F:
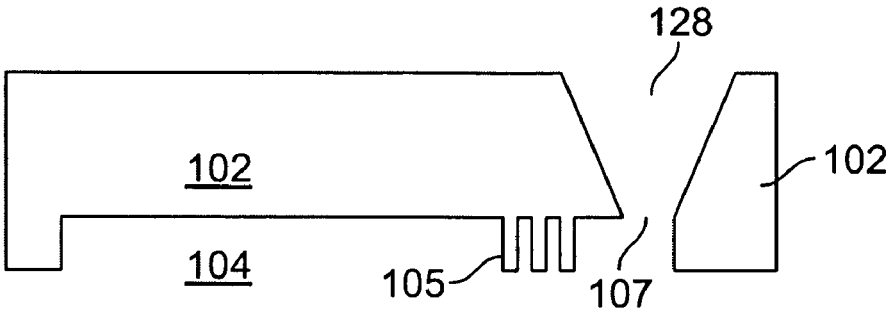

Referring to FIG. 8E, a photoresist layer 239 is spun onto the back side 215 of the silicon substrate 200 and patterned to define the location of the ink channel 128. The thermal oxide layer 208 is removed by ICP RIE, and the silicon substrate is then etched using anisotropic etching with KOH (step 406). Referring to FIG. 8F, the photoresist layer 239, front oxide 203 and back oxide 208 are stripped from the substrate 200 and the substrate 200 is piranha cleaned and RCA cleaned, completing the base substrate 101 (step 408). Optionally, a heater or heaters 127 can be formed on the back face 126 of the base substrate 101, for example, by sputtering NiChrome onto the back side 215 of the silicon substrate 200 and photolithographically etching to pattern the heaters 127.

Figure 8G:
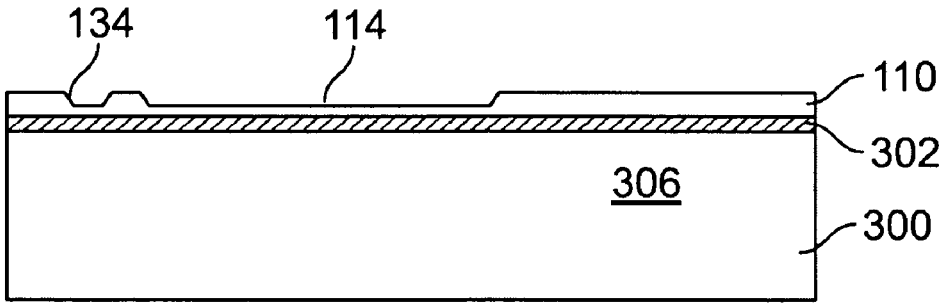

Referring to FIG. 8G, the nozzle plate 110 is formed from a silicon-on-insulator substrate 300 (SOI 300) (step 410). The SOI 300 includes the nozzle silicon layer plate 110, a buried oxide layer 302 and a handle layer 306. Before bonding the SOI 300 to the base substrate 101, tapered walls 134 and a region of reduced thickness 114 are formed by anistropically etching in the substrate 300 with KOH. In one embodiment, the nozzle plate 110 can be approximately 10 microns thick. An aperture for the nozzle 112 is etched only part way into the nozzle plate 110, e.g., 5 microns, and does not extend to the buried oxide layer 302.

Figure 8H:
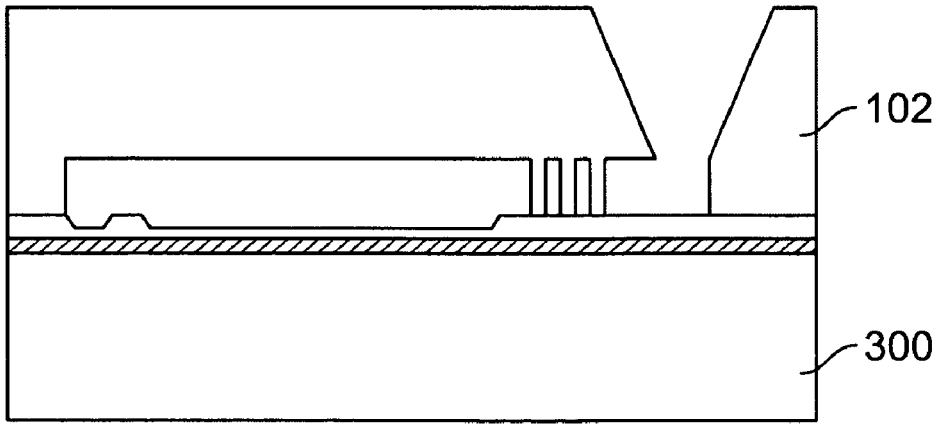
Figure 8I:
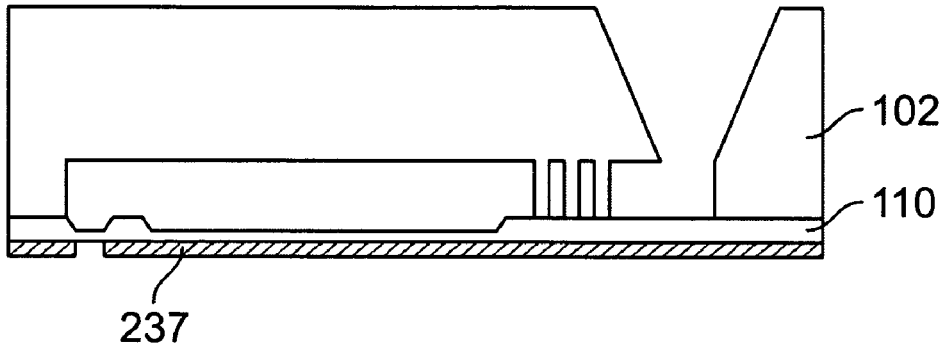
Figure 8J:
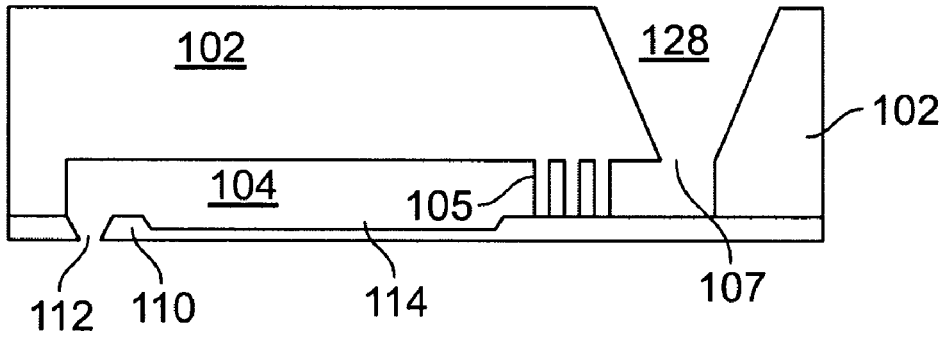

Referring to FIG. 8H, the SOI 300 and the base substrate 101 are aligned, and bonded to one another by annealing to create a fusion bond (step 412). Other bonding techniques can be used, including a layer of benzocycolbutene (BCB) adhesion promoter. Referring to FIG. 81, the handle layer 306 is ground and etched and the buried oxide layer 302 is stripped from the nozzle plate 110 (step 414). A photoresist layer 237 is applied to the nozzle plate 110 and patterned to define the location of the nozzle 112. The nozzle plate 110 is etched (e.g., DRIE) to form the nozzle opening, as shown in FIG. 8J (step 416). The photoresist layer 237 is stripped and the assembly of the base substrate 101 and the nozzle plate 110 is baked at 1100° C. for about 4 hours to remove any polymer or organics.

Figure 8K:
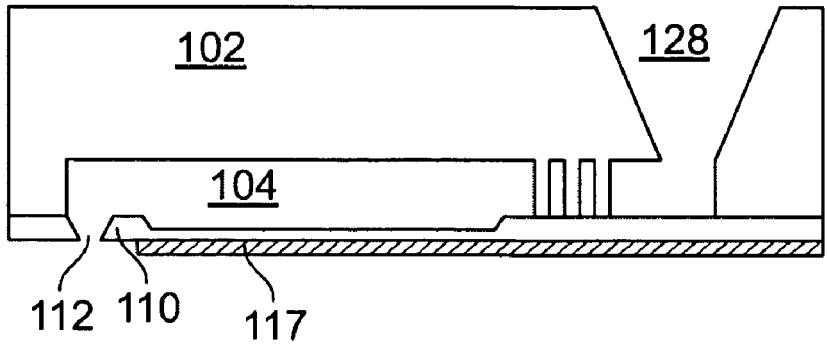

Referring to FIG. 8K, a ground electrode layer 117 is deposited on the nozzle plate 110 with a cut-out region to expose the nozzles 112. In one implementation, the ground electrode layer 117 can be formed by masking off the region including the nozzles 112 (e.g., providing a physical barrier such as tape), and depositing a conductive material, e.g., gold, over the exposed area of the nozzle plate 110. The mask can be removed from the region including the nozzles 112 to expose the nozzles 112.

Figure 8L:
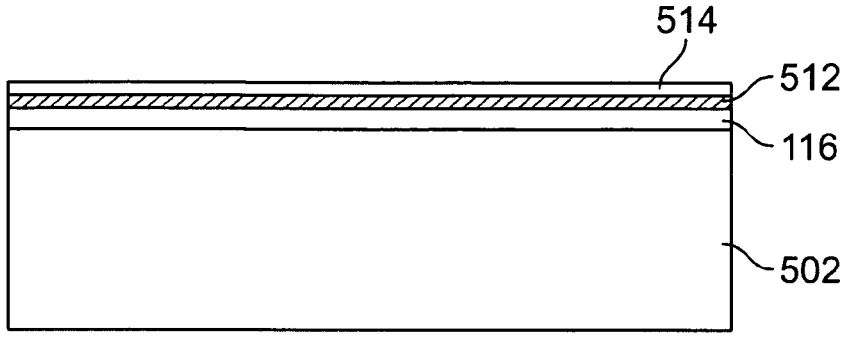

Referring to FIG. 8L, the piezoelectric layer 116 is formed from a block of pre-fired piezoelectric material that is about 1 mm thick (step 418). The block is ground to approximately 65 microns to create a planar uniform crystalline surface and cleaned in a 1% solution of fluoroboric acid ($HBF_4$) to remove surface damage caused by the grinding. The piezoelectric layer 116 is bonded onto a sacrificial silicon substrate 502 using a layer of BCB adhesion promoter, and cured for approximately 40 hours.

The exposed surface of the piezoelectric layer 116 is metalized, for example, with a layer of Ti-Tungsten 512, as depicted in FIG. 8L (step 420). The metal layer 512 will bond and electrically connect to the metallic ground electrode layer 117 formed on the nozzle plate 110, as described above. A layer 514 of BCB adhesion promoter can be layered on top of the metal layer 512, to prepare the piezoelectric layer 116 for bonding to the nozzle plate 110.

Figure 8M:
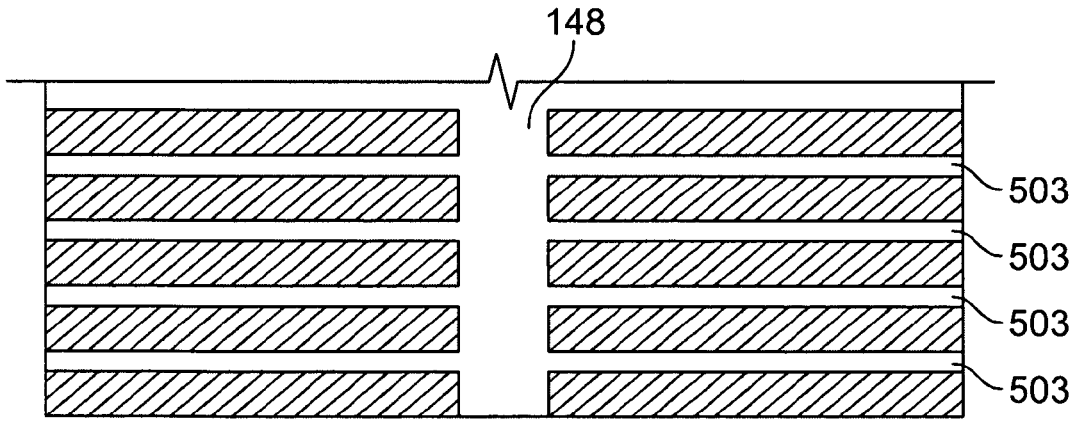

Before bonding the piezoelectric layer 116 to the nozzle plate 110, the piezoelectric material is sectioned to create multiple actuator portions (step 420). FIG. 8M shows a top view of a portion of the piezoelectric layer 116 and silicon substrate 502, after the piezoelectric layer 116 has been sectioned to create the multiple actuator portions. Each actuator portion corresponds to a separate pumping chamber 104 in the base substrate 101. Note that the entire width of the piezoelectric layer 116 is shown in FIG. 8M, as compared to the approximate half width of the piezoelectric layer shown in the cross-sectional side view of FIG. 8L. To form the actuator portions, cuts are made in the piezoelectric material to form an isolation area 148 above the region that will correspond to the nozzles 112 formed in the nozzle plate 112 and to form the channels 503. The piezoelectric layer 116 is not etched through to the sacrificial silicon substrate 502, but stops short approximately 10 microns.

Figure 8N:
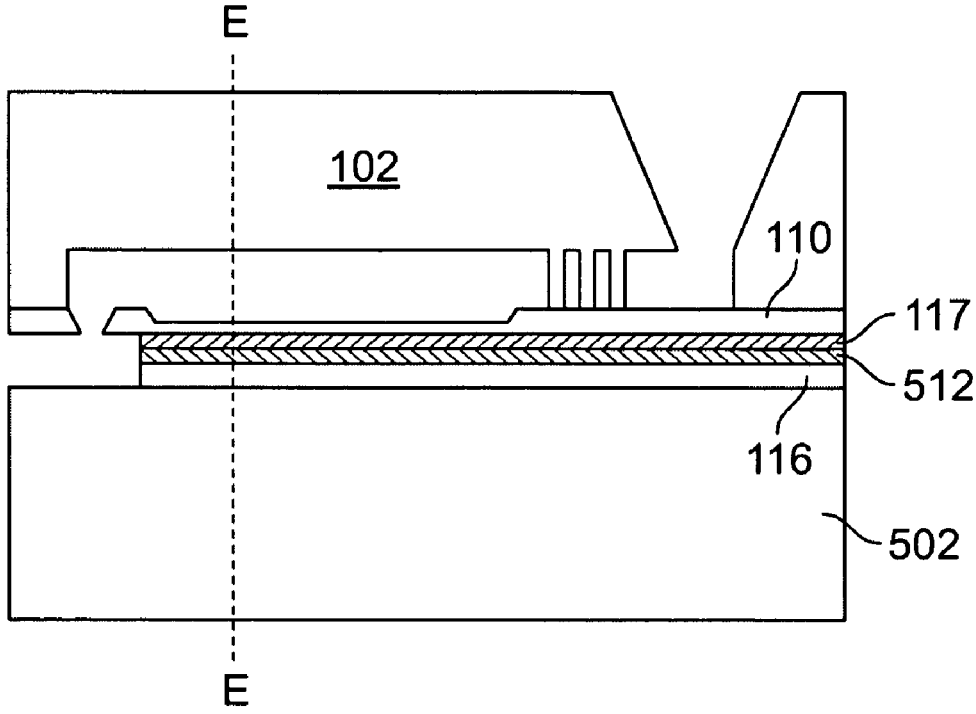

Referring to FIG. 8N, the piezoelectric layer 116 and the assembly of the printhead body 102 and nozzle plate 110 (with ground electrode layer 117 thereon) are aligned and brought together so that the isolation cut 148 is over the nozzle 112 and the channel cuts 503 are over the walls separating the adjacent pumping chambers 104. The piezoelectric layer 116 and assembly are bonded together, e.g., in an EV bonder (step 422) to form the printhead body 102. The printhead body 102 is placed in a quartz oven at 200° C. for 40 hours to polymerize the BCB layer 514.

Figure 8O:
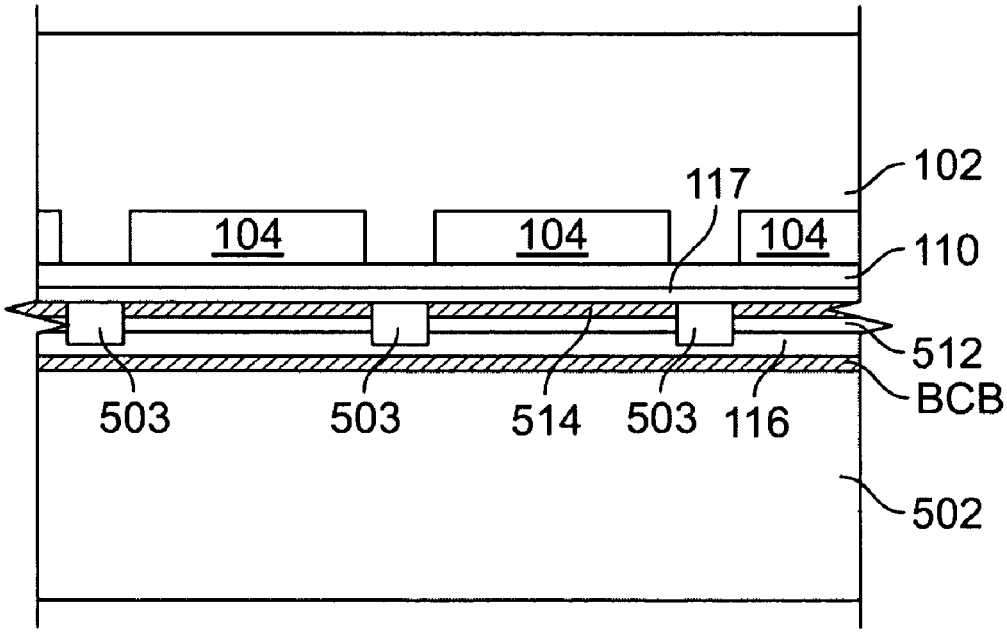

FIG. 8O shows a cross-sectional view of the assembly shown in FIG. 8N taken along line D-D along a plane going into the page. The channels 503 cut into the piezoelectric layer 116 are aligned with the walls separating the pumping chambers 104 formed in the printhead body 102. The ground electrode layer 117 can electrically connect to the metal layer 512 formed on the piezoelectric layer 116 through the BCB layer 514. In this view, the adhesive layer of BCB between the piezoelectric layer 116 and the sacrificial silicon substrate 502 is shown.

Figure 8P:
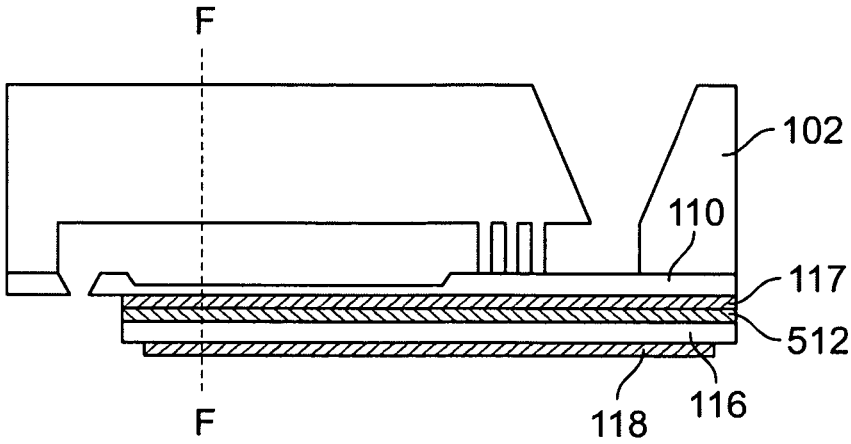

Referring to FIG. 8P, the silicon handle layer 502 and part of the piezoelectric layer 116 are removed by grinding (step 424). The piezoelectric layer 116 is ground again and cleaned in fluoroboric acid. The piezoelectric layer 116 can be about 15 microns when processing is complete. A metal layer 118 is disposed on the exposed surface of the piezoelectric layer 116 by sputtering layers of metal, e.g., titanium-tungsten and/or gold. The metal layer 118 is then photolithographically etched to form the drive contacts 122 and drive electrodes 120.

Figure 8Q:
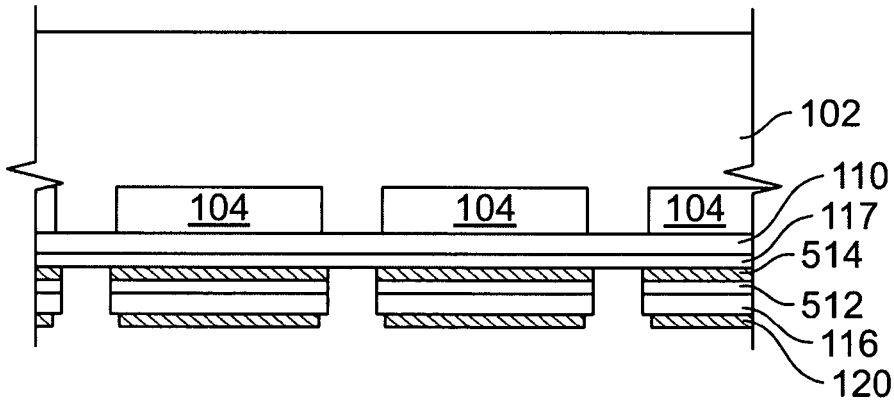

FIG. 8Q shows a cross-sectional view of the assembly shown in FIG. 8P taken along line E-E along a plane going into the page, after the metal layer 118 has been etched to form the drive electrodes 120 and drive contacts 122. The piezoelectric layer 116 is sandwiched between the metal layer 512, e.g., Ti-Tungsten, which is electrically connected to the metallic ground electrode layer 117, and the metal layer, e.g., gold, forming the drive contacts 122 and drive electrodes 120. By applying different voltages to the ground electrode layer 117 and the drive electrode 120, a region of the piezoelectric layer 116 over a pumping chamber 104 can be actuated. That is, the voltage differential can cause the piezoelectric layer 116 to flex, thereby pressurizing the ink in the pumping chamber 104.

In general, silicon and silicon oxide layers can be selectively etched by conventional plasma etching with commercially-purchased equipment. For silicon etching features with straight side walls, the Bosch process can be used in which etching with $SF_6$ and $C_4F_8$ alternates with depositing a polymer in 11 second cycles. The photoresist layer can be a commercially available positive UV photoresist system. The process can be performed at −20° C. to improve the etch selectivity and prolong the useful life of the photoresist layer.

Figure 10:
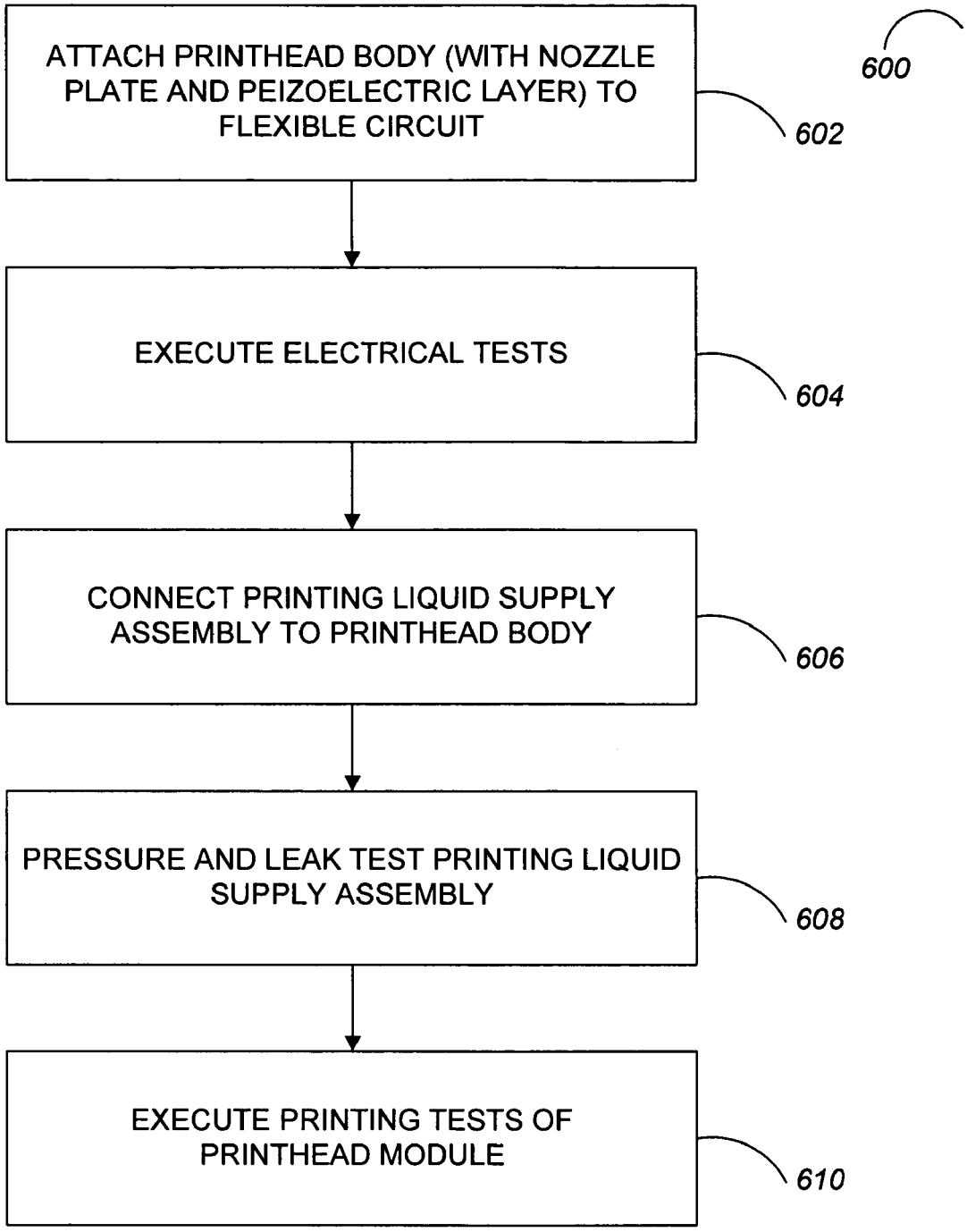
FIG. 10 is a flowchart showing a process for assembling a printhead module.

Referring to FIG. 10, the printhead module 150 can be assembled according to the following steps. The printhead body 102, i.e., the base substrate 101, nozzle plate 110, and piezoelectric layer 116, can be connected to the flexible circuit 130 (step 602). Electrical tests can be executed to ensure that signals are passing from the flexible circuit 130 to the printhead body 102 (step 604). The ink supply assembly 140 is connected to the printhead body 102, with the flexible circuit 130 attached (step 606) to complete the printhead module 150. Pressure and leak tests can be executed to ensure that ink is traveling through the printhead module 150 without leakage (step 608). Printing tests can be executed to ensure that the printhead module 150 prints ink as required (step 610).

Figure 11:
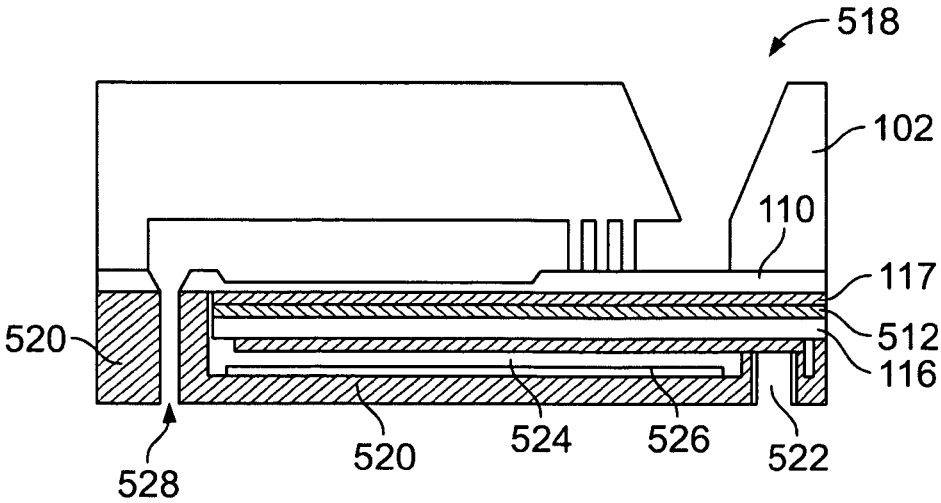
FIG. 11 is a cross-sectional side view of a portion of a printhead module including a cap.

Referring to FIG. 11, in another embodiment, a printhead module 518 can include a silicon cap 520 formed over the nozzle face and piezoelectric layer 116. The silicon cap 520 is thicker and more robust than the relatively thin silicon membrane formed over the pumping chambers 104 and piezoelectric layer 116, providing a protective cover. FIG. 11 shows a cross-sectional side view of a portion of a printhead module 518, similar to the view shown in FIG. 8P. A via (through hole) 522 is formed through the silicon cap 520 to the drive contact 122. The via is coated with a conductive material to provide an electrical connection between the drive contact 122 and a flexible circuit that can be connected to the exterior of the silicon cap 520, to provide signals to the drive contact 122. A recess 524 is formed in the silicon cap 520 to provide room for the piezoelectric layer 116 to flex when actuated by the drive contact 122 and drive electrode 120. Optionally, a heater 526, e.g., a Nichrome heater, can be included within the recess 524, which can be in addition to or instead of another heater included in the module. The shape of the nozzle can be determined by the shape of the passage 528 through the silicon cap 520. In one implementation, the nozzle can be formed in the silicon cap 520, in which case the passage 528 would be wider to be consistent with the width at the inner portion of the nozzle. The silicon cap 520 can be formed using etching techniques, including those described above, and adhered to the nozzle face of the printhead module 518.

As previously mentioned, ink is just one example of a printing liquid. It should be understood that reference about to ink as the printing liquid was for illustrative purposes only, and referring to components within the printhead module described above with the adjective "ink" was also illustrative. That is, referring to a channel or a supply assembly as an "ink channel" or an "ink supply assembly" was for illustrative purposes, and a more general reference, such as to a "printing liquid channel" or a "printing liquid supply assembly" can be used. Further, the use of terminology such as "front" and "back" and "top" and "bottom" throughout the specification and claims is for illustrative purposes only, to distinguish between various components of the printhead module and other elements described herein. The use of "front" and "back" and "top" and "bottom" does not imply a particular orientation of the printhead module.

Although only a few embodiments have been described in detail above, other modifications are possible. Other embodiments may be within the scope of the following claims.

What is claimed is:

1. A printhead module, comprising:

a printhead body including one or more pumping chambers, where each pumping chamber includes a receiving end configured to receive a printing liquid from a printing liquid supply and an ejecting end for ejecting the printing liquid from the pumping chamber;

a nozzle plate including one or more nozzles formed through the nozzle plate, where a nozzle is in fluid communication with each pumping chamber and receives printing liquid from the ejecting end of the pumping chamber for ejection from the nozzle and where the nozzle plate includes one or more regions of reduced thickness and where an inner surface of each such region forms an inner surface of each of the one or more pumping chambers; and one or more piezoelectric actuators connected to the nozzle plate, where a piezoelectric actuator is positioned over each pumping chamber and includes a piezoelectric material configured to deflect and pressurize the pumping chamber, so as to eject printing liquid from a corresponding nozzle that is in fluid communication with the ejecting end of the pumping chamber and where the piezoelectric material is positioned between a first and a second electrode and the first electrode is positioned between the piezoelectric material and an outer surface of one of the regions of reduced thickness of the nozzle plate.

2. The printhead module of claim 1, further comprising:

a printing liquid supply assembly, where the printing liquid supply assembly includes a reservoir in fluid communication with the receiving end of the pumping chamber;

wherein:

the printhead body includes a back face that is substantially parallel to a nozzle face which connects to the nozzle plate;

the printing liquid supply assembly is connected to the back face of the printhead body; and the receiving end of the pumping chamber includes an opening on the back face of the printhead body in fluid communication with the reservoir.

3. The printhead module of claim 2, wherein the printhead module includes a plurality of pumping chambers, the printhead module farther comprising:

at least one printing liquid channel formed in the back face of the printhead body, the at least one printing liquid channel in fluid communication with openings of a plurality of pumping chambers and with the reservoir, where printing liquid enters the at least one printing liquid channel from the reservoir and is directed into the openings of the plurality of pumping chambers.

4. The printhead module of claim 3, wherein the at least one printing liquid channel includes at least two sides angled toward the openings of the plurality of pumping chambers.

5. A printhead system comprising:

a printhead module having a nozzle face and a back face substantially parallel to and opposite the nozzle face, the printhead module including:

a printhead body including one or more pumping chambers, where each pumping chamber includes a receiving end configured to receive a printing liquid from a printing liquid supply and an ejecting end for ejecting the printing liquid from the pumping chamber;

a nozzle plate including one or more nozzles formed through the nozzle plate, where a nozzle is in fluid communication with each pumping chamber and receives printing liquid from the ejecting end of the pumping chamber for ejection from the nozzle and where the nozzle plate includes one or more regions of reduced thickness and where an inner surface of each such region forms an inner surface of each of the one or more pumping chambers; and one or more piezoelectric actuators connected to the nozzle plate, where a piezoelectric actuator is positioned over each pumping chamber and includes a piezoelectric material configured to deflect and pressurize the pumping chamber, so as to eject printing liquid from a corresponding nozzle that is in fluid communication with the ejecting end of the pumping chamber and where the piezoelectric material is positioned between a first and a second electrode and the first electrode is positioned between the piezoelectric material and an outer surface of one of the regions of reduced thickness of the nozzle plate; and a flexible circuit connected to the nozzle face of the printhead module and electrically coupled to the one or more piezoelectric actuators so as to provide signals to the one or more piezoelectric actuators to selectively pressurize the one or more pumping chambers to fire the one or more corresponding nozzles.

6. A printhead system comprising:

a printhead module, including:

a printhead body including one or more pumping chambers, where each pumping chamber includes a receiving end configured to receive a printing liquid from a printing liquid supply and an ejecting end for ejecting the printing liquid from the pumping chamber;

a nozzle plate including one or more nozzles formed through the nozzle plate, where a nozzle is in fluid communication with each pumping chamber and receives printing liquid from the ejecting end of the pumping chamber for ejection from the nozzle and where the nozzle plate includes one or more regions of reduced thickness and where an inner surface of each such region forms an inner surface of each of the one or more pumping chambers;

one or more piezoelectric actuators connected to the nozzle plate, where a piezoelectric actuator is positioned over each pumping chamber and includes a piezoelectric material configured to deflect and pressurize the pumping chamber, so as to eject printing liquid from a corresponding nozzle that is in fluid communication with the ejecting end of the pumping chamber and where the piezoelectric material is positioned between a first and a second electrode and the first electrode is positioned between the piezoelectric material and an outer surface of one of the regions of reduced thickness of the nozzle plate; and a cap attached to the nozzle plate and including one or more apertures connecting to the one or more nozzles formed through the nozzle plate, where the cap is configured to cover the one or more piezoelectric actuators while providing sufficient clearance for the piezoelectric material included in the one or more actuators to deflect when actuated.

7. The printhead system of claim 6, where the cap further comprises one or more vias coated with an electrically conductive layer connecting an exterior face of the cap to the one or more piezoelectric actuators, the printhead system further comprising:

a flexible circuit connected to the exterior face of the cap of the printhead module and electrically coupled to the one or more piezoelectric actuators by the one or more vias so as to provide signals to the one or more piezoelectric actuators to selectively pressurize the one or more pumping chambers to fire the one or more corresponding nozzles.

8. The printhead system of claim 6, where the printhead module further comprises:

a printing liquid supply assembly, where the printing liquid supply assembly includes a reservoir in fluid communication with the receiving end of the pumping chamber;

wherein:

the printhead body includes a back face that is substantially parallel to a nozzle face which connects to the nozzle plate;

the printing liquid supply assembly is connected to the back face of the printhead body; and the receiving end of the pumping chamber includes an opening on the back face of the printhead body in fluid communication with the reservoir.

9. The printhead system of claim 8, where the printhead module includes a plurality of pumping chambers, the printhead module further comprising:

at least one printing liquid channel formed in the back face of the printhead body, the at least one printing liquid channel in fluid communication with openings of a plurality of pumping chambers and with the reservoir, where printing liquid enters the at least one printing liquid channel from the reservoir and is directed into the openings of the plurality of pumping chambers.

10. The printhead system of claim 9, where the at least one printing liquid channel includes at least two sides angled toward the openings of the plurality of pumping chambers.

11. A printhead system comprising:

a printhead module, including:

a printhead body including one or more pumping chambers, where each pumping chamber includes a receiving end configured to receive a printing liquid from a printing liquid supply and an ejecting end for ejecting the printing liquid from the pumping chamber;

a nozzle plate including one or more nozzles formed through the nozzle plate, where a nozzle is in fluid communication with each pumping chamber and receives printing liquid from the ejecting end of the pumping chamber for ejection from the nozzle;

one or more piezoelectric actuators connected to the nozzle plate, where a piezoelectric actuator is positioned over each pumping chamber and includes a piezoelectric material configured to deflect and pressurize the pumping chamber, so as to eject printing liquid from a corresponding nozzle that is in fluid communication with the ejecting end of the pumping chamber;

a cap attached to the nozzle plate and including one or more apertures connecting to the one or more nozzles formed through the nozzle plate, where the cap is configured to cover the one or more piezoelectric actuators while providing sufficient clearance for the piezoelectric material included in the one or more actuators to deflect when actuated, where the cap further comprises one or more vias coated with an electrically conductive layer connecting an exterior face of the cap to the one or more piezoelectric actuators; and a flexible circuit connected to the exterior face of the cap of the printhead module and electrically coupled to the one or more piezoelectric actuators by the one or more vias so as to provide signals to the one or more piezoelectric actuators to selectively pressurize the one or more pumping chambers to fire the one or more corresponding nozzles.

* * * * *